US006375566B1

(12) United States Patent
Yamada

(10) Patent No.: US 6,375,566 B1
(45) Date of Patent: Apr. 23, 2002

(54) GAME SYSTEM, COMPUTER-READABLE STORAGE MEDIUM, AND STORAGE DEVICE FOR USE IN A CARD GAME

(75) Inventor: Nobuhiro Yamada, Hannou (JP)

(73) Assignee: Konami Co., Ltd., Hyogo-ken (JP)

( * ) Notice: Subject to any disclaimer, the term of this patent is extended or adjusted under 35 U.S.C. 154(b) by 0 days.

(21) Appl. No.: 09/404,998

(22) Filed: Sep. 27, 1999

(30) Foreign Application Priority Data

Sep. 25, 1998 (JP) ..... 10-271888
Mar. 18, 1999 (JP) ..... 11-074631

(51) Int. Cl.[7] ..... A63F 9/24
(52) U.S. Cl. ..... 463/1; 463/43; 273/308
(58) Field of Search ..... 463/43–44, 1, 463/37, 42; 273/292, 460–461, 459, 308, 244, 244.1, 244.2, 237

(56) References Cited

U.S. PATENT DOCUMENTS 5,071,136 A * 12/1991 Lott ..... 273/259
5,145,173 A * 9/1992 Crowder ..... 273/93 C
5,201,525 A * 4/1993 Castro ..... 273/293
5,411,259 A * 5/1995 Pearson et al. ..... 273/93 C
5,662,332 A 9/1997 Garfield ..... 273/308
6,200,216 B1 * 3/2001 Peppel ..... 463/1
6,251,010 B1 * 6/2001 Tajiri et al. ..... 463/1

FOREIGN PATENT DOCUMENTS

JP 2-210562 8/1990

* cited by examiner

*Primary Examiner*—Michael O'Neill
*Assistant Examiner*—Scott E. Jones
(74) *Attorney, Agent, or Firm*—Sughrue Mion, PLLC

(57) ABSTRACT

In a game system for use in a card game by using a plurality of cards which individually have predetermined ability points, a plurality of competition environments are prepared to change the ability points from one to another at every one of the competition environments. Each of the competition environments is determined by a field card. To this end, the game system has a storage device which stores the ability points varied in dependency upon the competition environments. The ability points of each card is stored as attack and defense ability points different from each other and varied by the competition environments. Any other cards, such as magic cards, trap cards, may be prepared.

36 Claims, 20 Drawing Sheets

| | | NORMAL | | FOREST | | WILDERNESS | | MOUNTAIN | | GRASSLAND | | SEA | | DARKNESS | |
|---|---|---|---|---|---|---|---|---|---|---|---|---|---|---|---|
| CARD NAME | FILE NAME | ATTACK | DE-FENCE | ATTACK | DE-FENCE | ATTACK | DE-FENCE | ATTACK | DE-FENCE | ATTACK | DE-FENCE | ATTACK | DE-FENCE | ATTACK | DE-FENCE |
| A00 | m000 | 3000 | 2500 | 3300 | 2750 | 3300 | 2750 | 3900 | 3250 | 3000 | 2500 | 3300 | 2750 | 3000 | 2500 |
| A01 | m001 | 800 | 2000 | 880 | 2200 | 720 | 1800 | 720 | 1800 | 800 | 2000 | 880 | 2200 | 880 | 2200 |
| A02 | m002 | 1200 | 1000 | 1560 | 1300 | 1320 | 1100 | 1080 | 900 | 1560 | 1300 | 1080 | 990 | 1200 | 1000 |
| A03 | m003 | 1200 | 700 | 1320 | 770 | 1320 | 770 | 1560 | 910 | 1200 | 700 | 1320 | 770 | 1200 | 700 |
| A04 | m004 | 1000 | 500 | 1000 | 500 | 900 | 450 | 900 | 450 | 900 | 450 | 900 | 450 | 1300 | 650 |
| A05 | m005 | 1300 | 1400 | 1300 | 1400 | 1300 | 1400 | 1170 | 1260 | 1170 | 1260 | 1170 | 1260 | 1690 | 1820 |
| A06 | m006 | 1400 | 1200 | 1540 | 1320 | 1540 | 1320 | 1820 | 1560 | 1540 | 1320 | 1540 | 1320 | 1400 | 1200 |
| A07 | m007 | 800 | 600 | 1040 | 780 | 720 | 540 | 720 | 540 | 880 | 660 | 720 | 540 | 560 | 420 |
| A08 | m008 | 500 | 200 | 550 | 220 | 650 | 260 | 500 | 200 | 500 | 200 | 350 | 140 | 850 | 260 |
| A09 | m009 | 1500 | 800 | 1650 | 880 | 1650 | 880 | 1950 | 1040 | 1650 | 880 | 1650 | 880 | 1500 | 800 |
| B00 | m010 | 1750 | 2030 | 1925 | 2233 | 2275 | 2639 | 1575 | 1827 | 1925 | 2233 | 1225 | 1421 | 1750 | 2030 |
| B01 | m011 | 1800 | 1500 | 1800 | 1500 | 1980 | 1650 | 1620 | 1350 | 2340 | 1950 | 1620 | 1350 | 1800 | 1500 |
| B02 | m012 | 1200 | 1400 | 1320 | 1540 | 1200 | 1400 | 1560 | 1820 | 1200 | 1400 | 1320 | 1540 | 840 | 980 |
| B03 | | 1800 | | 2340 | | 1980 | | 1620 | | 1800 | | 1620 | | 1800 | |
| . | . | . | . | . | . | . | . | . | . | . | . | . | . | . | . |
| . | . | . | . | . | . | . | . | . | . | . | . | . | . | . | . |
| . | . | . | . | . | . | . | . | . | . | . | . | . | . | . | . |
| . | . | . | . | . | . | . | . | . | . | . | . | . | . | . | . |
| . | . | . | . | . | . | . | . | . | . | . | . | . | . | . | . |
| . | . | . | . | . | . | . | . | . | . | . | . | . | . | . | . |
| . | . | . | . | . | . | . | . | . | . | . | . | . | . | . | . |
| | m076 | | 1200 | | 1320 | | 1200 | | 840 | | 1200 | | 1200 | | 1200 |
| H07 | m077 | 1700 | 1150 | 1700 | 1150 | 1870 | 1265 | 1530 | 1035 | 2210 | 1495 | 1530 | 1035 | 1700 | 1150 |
| H08 | m078 | 1800 | 2000 | 1980 | 2200 | 2340 | 2600 | 1620 | 1800 | 1980 | 2200 | 1260 | 1400 | 1800 | 2000 |
| H09 | m079 | 1500 | 800 | 1650 | 880 | 1950 | 1040 | 1350 | 720 | 1650 | 880 | 1050 | 560 | 1500 | 800 |
| 100 | m080 | 1600 | 1200 | 1760 | 1320 | 2080 | 1560 | 1440 | 1080 | 1760 | 1320 | 1120 | 840 | 1600 | 1200 |
| 101 | m081 | 2400 | 2000 | 2640 | 2200 | 2400 | 2000 | 3120 | 2600 | 2640 | 2200 | 2640 | 2200 | 2400 | 2000 |
| 102 | m082 | 920 | 1930 | 920 | 1930 | 828 | 1737 | 828 | 1737 | 828 | 1737 | 828 | 1737 | 1200 | 2500 |
| 103 | m083 | 1380 | 1930 | 1380 | 1930 | 1242 | 1737 | 1242 | 1737 | 1242 | 1737 | 1242 | 1737 | 1800 | 2500 |
| 104 | m084 | 2000 | 1530 | 2000 | 1530 | 1800 | 1377 | 1800 | 1377 | 1800 | 1377 | 1800 | 1377 | 2600 | 2000 |
| 105 | m085 | 1380 | 1530 | 1380 | 1530 | 1242 | 1377 | 1242 | 1377 | 1242 | 1377 | 1242 | 1377 | 1800 | 2000 |
| 106 | m086 | 1610 | 1450 | 1610 | 1460 | 1449 | 1314 | 1449 | 1314 | 1449 | 1314 | 1449 | 1314 | 2100 | 1900 |
| 107 | m087 | 1150 | 2150 | 1150 | 2150 | 1035 | 1935 | 1035 | 1935 | 1035 | 1935 | 1035 | 1935 | 1500 | 2800 |
| 108 | m088 | 1000 | 2000 | 1000 | 2000 | 900 | 1800 | 700 | 1400 | 1000 | 2000 | 1300 | 2600 | 1000 | 2000 |
| 109 | m089 | 1800 | 2000 | 1800 | 2000 | 1980 | 2200 | 1980 | 2200 | 1980 | 2200 | 1980 | 2200 | 1260 | 1400 |
| J00 | m090 | 1300 | 1550 | 1690 | 2015 | 1300 | 1550 | 1300 | 1550 | 1430 | 1705 | 910 | 1085 | 1300 | 1550 |
| J01 | m091 | 2000 | 1700 | 2600 | 2210 | 2200 | 1870 | 1800 | 1530 | 2600 | 2210 | 1800 | 1530 | 2000 | 1700 |

FIG.4

GAME SYSTEM, COMPUTER-READABLE STORAGE MEDIUM, AND STORAGE DEVICE FOR USE IN A CARD GAME

BACKGROUND OF THE INVENTION

This invention relates to a computer-readable storage medium, a storage device each of which stores a card game program of a card game played on a computer system, and a game device which can enjoy the card game in accordance with the card game program.

In general, a card game has been proposed in U.S. Pat. No. 5,662,332 (will be simply called Reference hereinafter) and might be enjoyed or played among players by alternately putting each card on a playing field. Specifically, disclosure is made in Reference about the card game which prepares various kinds of cards which have abilities, roles, and attributes different from one another and in which a predetermined life point is assigned to each of the players. During the card game, each player alternately places the cards one by one on the playing field. Thus, the card game is progressive or advanced until the predetermined life point assigned to either one of the players is reduced to zero. Such a card game is named "Magic the Gathering" and has been widely sold.

As mentioned before, the cards which are used in the card game are classified into a plurality of species on the basis of the attributes, the abilities, and the roles given to the cards. In addition, the cards can be purchased, supplemented, or exchanged individually or in a set. Therefore, each player does not have the same cards in this card game.

Under the circumstances, it is possible with this card game not only to capture or awaken a different interest and a variation in dependency upon the cards which are held by the players but also to enjoy a collection of the cards.

Furthermore, Reference suggests that the proposed card game can be executed on a computer when the card game is formed by a software program.

However, the card game must use a very wide variety of cards which have different abilities and attributes and must be executed in accordance with a very complicated rule. This shows that amateurs and children can neither simply enjoy nor be familiar with the card game. Accordingly, the card game is very popular only among game mania who are experts for the card game.

Taking the above into consideration, it is readily understood that an increase of customers or users for the card game can not be expected, even when the card game proposed in Reference is realized by the program as it stands. This means that it is very important that the card game rule can be simplified without spoiling everybody's fun, when such a card game is realized by a program.

On the other hand, a lot of game manias tend to demand or direct more interesting and high functional games. In order to respond to their demands, one way would be to complicate a rule of the card game. However, such complication of the rule can not attract an interest of children and amateurs except the game manias, as already mentioned before, and results in impeding popularization of the card game. At any rate, it is preferable that such a card game can be enjoyed by various people, such as children, amateurs, and manias.

SUMMARY OF THE INVENTION

It is an object of this invention to provide a computer-readable storage medium which stores a computer readable software program for a card game enjoyed among a wide variety of people from amateurs to experts.

It is another object of this invention to provide a computer-readable storage medium of the type described, wherein the program can does not need to complicate a card game rule.

It is still another object of this invention to provide a computer-readable storage medium of the type described, wherein the program can draw the interest of the players by varying game environments of each card game and by changing strength of each card in accordance with each game environment.

It is yet another object of this invention to provide a computer-readable storage medium of the type described, wherein the program can enjoy more interesting card game by realizing different operations on attack or defense.

It is another object of this invention to provide a memory which stores data peculiar to the above-mentioned program.

It is another object of this invention to provide a game device which can play the above-mentioned card game.

According to an aspect of this invention, a computer-readable storage medium is for storing a program which is readable by the use of a computer to execute a card game composed of a plurality of cards. The cards have individually ability points different from one another. The computer-readable storage medium comprises a card storing portion which stores a plurality of field cards each of which defines a competition environment different from one another and a list which stores the cards having ability points varied in dependency upon the competition environments determined by the field cards. The program comprises the steps of determining each competition environment on the basis of the field cards and executing the card game with reference to the ability points of each card under each competition environment determined by the field cards. In this event, the cards are selectively used as an attack side and a defense side and the cards have, as the ability points, attack ability points and defense ability points used as the attack and the defense sides, respectively.

Inasmuch as the attack and the defense ability points are varied in dependency upon the competition environments, the card game becomes more interesting.

In addition, the program may comprise the steps of detecting a specific combination of the cards and generating a new card which is different from the cards used in the specific combination.

According to another aspect of this invention, a storage device is for use in a card game played between players by putting, in a predetermined area, cards which have individually ability points. The storage device comprises a storage area which stores the ability points varied in dependency upon competition environments.

According to still another aspect of this invention, a game system is operable to play a card game between players by putting cards which have predetermined ability points. The game system comprises storage means for storing the ability points of the cards which are varied under competition environments previously prepared and different from one another, executing means for executing the card game under a selected one of the competition environments with reference to the ability points of the cards determined in the selected competition environment, a display unit for displaying results of executing the program in the form of an image, and input means for inputting command and data for the card game on the basis of the image displayed on the display unit. The executing means may be operated in accordance with a program. The cards are selectively used as an attack side and a defense side and the cards have, as the ability points, attack ability points and defense ability points used as the attack and the defense sides, respectively. The executing means executes the card game with reference to the attack ability points and the defense ability points of each card which are varied in dependency upon the competition environments. The competition environments may be determined by a plurality of field cards.

With this game system, it is possible to increase a variation of the cards without increasing a species of the cards.

Moreover, the executing means processes a specific combination of the cards to produce a new card different from the cards of the specific combination.

According to another aspect of this invention, a game system is operable to play a card game such that a plurality of the cards can be summoned in the playing field at each turn of the players. In this event, the game system may comprise storage means for storing the ability points of the cards which are varied under competition environments previously prepared and different from one another, executing means for executing the card game under a selected one of the competition environments with reference to the ability points of the cards determined in the selected competition environment, a display unit for displaying results of executing the program in the form of an image, and input means for inputting command and data for the card game on the basis of the image displayed on the display unit. The display unit may display a special card zone for locating a special card which brings about a predetermined effect. The predetermined effect is to temporarily prohibit attack/defense of an opponent one of the players.

With this structure, it is possible to enjoy the card game which requires a wide variety of strategies and tactics.

BRIEF DESCRIPTION OF THE DRAWING

FIG. 4 partially shows a table for describing cards used in the card game according to this invention;

DESCRIPTION OF THE PREFERRED EMBODIMENTS

Figure 1A:
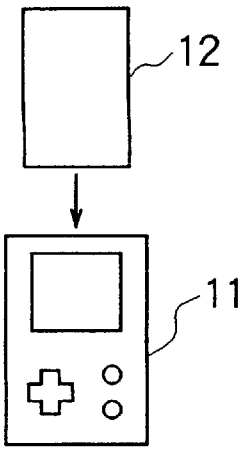
FIG. 1A shows a schematic view for use in describing a card game which is executed by a single player by the use of a portable game machine according to this invention.
Figure 1B:
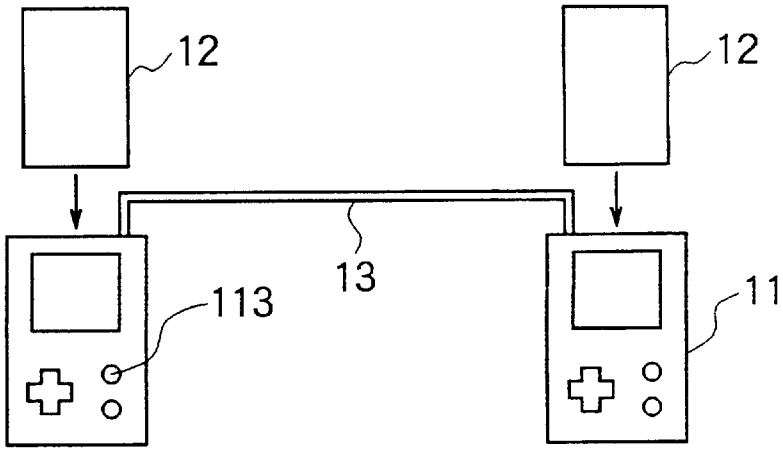
FIG. 1B shows a schematic view for use in describing the card game which is executed between two players by connecting, through a communication cable, two portable game machines according to this invention.

Referring to FIGS. 1A and 1B, two kinds of game styles or modes are illustrated which can enjoy a card game according to this invention, by the use of a portable game machine 11 which is known in the art. In this event, it is to be noted that the card game in question is stored in a cassette 12 in the form of a card game program and that the cassette 12 has a computer-readable storage medium for storing the card game program. In addition, the cassette 12 is set into the portable game machine 11, as symbolized by arrows in FIGS. 1A and 1B.

In the game mode illustrated in FIG. 1A, a single player alone can virtually play the card game with a computer equipped with a portable game machine when the cassette 12 is set into the portable game machine 11. In this case, the card game is progressive in accordance with the card game program stored in the cassette 12 and commands given by the player. The game mode shown in FIG. 1A may be therefore called a single player game mode.

In the game mode illustrated in FIG. 1B, the card game is played between the two portable game machines 11 which are operated by two players, respectively. As shown in FIG. 1B, both the portable game machines 11 are connected to each other through a communication cable 13. However, both the portable game machines 11 may be coupled to each other through an infrared ray. At any rate, the game mode of FIG. 1B may be called a double player mode.

As illustrated in FIGS. 1A and 1B, each portable game machine 11 has a liquid crystal display panel and a plurality of operation and selection buttons to give various commands to the portable game machine from each player or operator. As mentioned before, the portable game machine 11 is equipped with the cassette 12 which stores the card game program, when the card game is executed.

Figure 2:
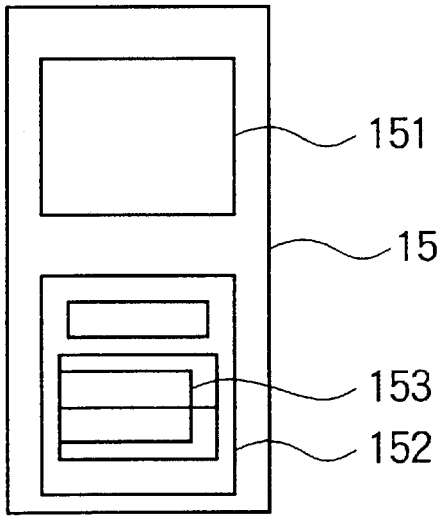
FIG. 2 shows a conceptional view for describing a computer-readable storage medium according to this invention.

Referring to FIG. 2, description will be schematically made about the computer-readable storage medium 15 held in the cassette 12 for a better understanding of this invention. The illustrated computer-readable storage medium 15 is formed by a read-only memory (ROM) structured by a semiconductor memory and has a command area 151 for storing a sequence of commands for the card game and a data area 152 for storing a wide variety of data signals used in the card game. Furthermore, the illustrated data area 152 has a partial data area 153 for storing a data signals which are peculiar to the card game and which will be mentioned later in detail. The partial data area 153 will be also described in conjunction with the data area 152.

Figure 3:
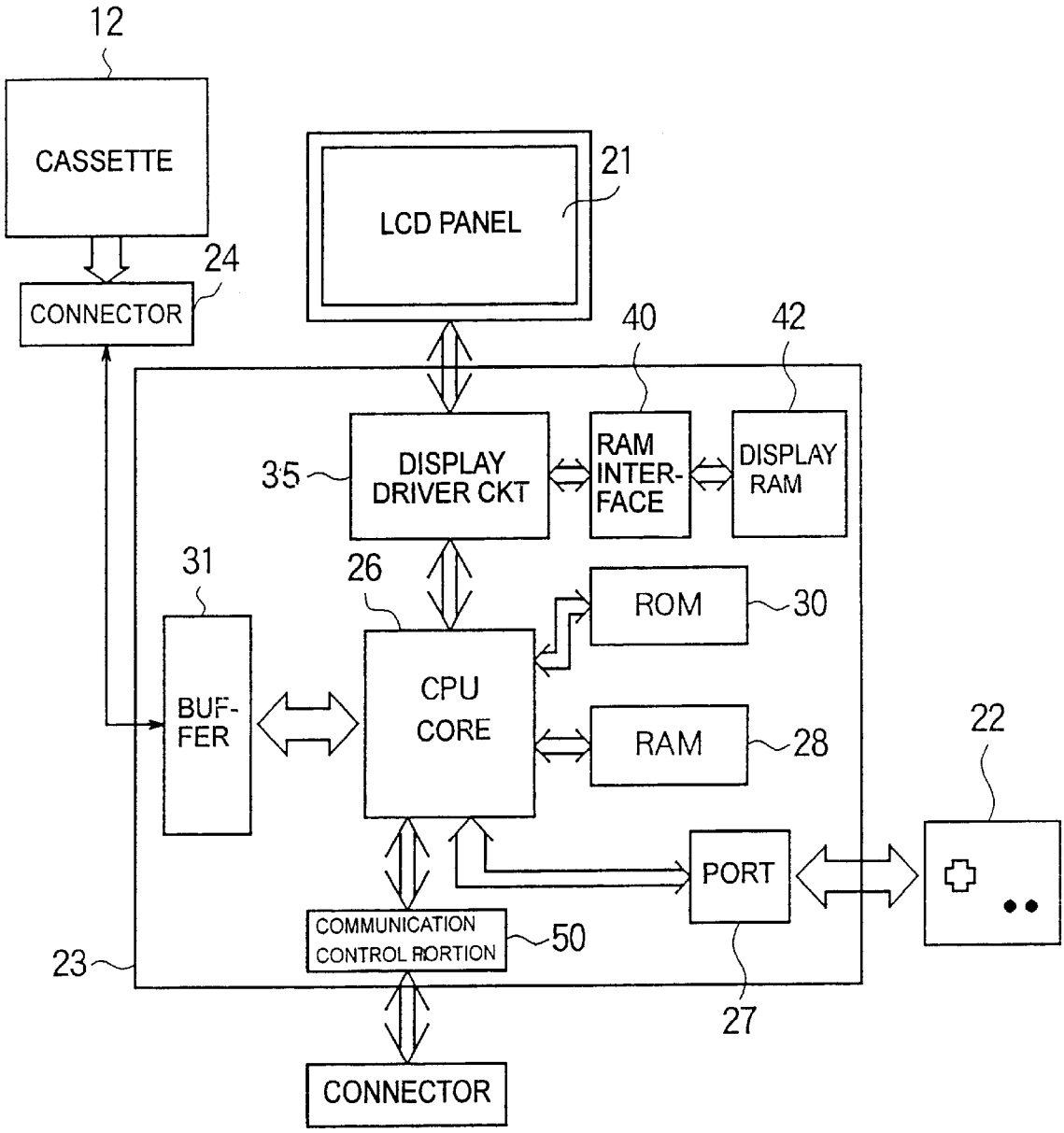
FIG. 3 shows a block diagram for use in describing the portable game machine used in this invention.

Referring to FIG. 3, the portable game machine 11 will be described which can executes the card game with the cassette 12 outfitted into the portable game machine 11. The illustrated portable game machine 11 itself is published in Japanese Unexamined Patent Publication No. Hei 2-210562, namely, 210562/1990 and has a liquid crystal display panel (simply abbreviated to an LCD panel hereinafter) 21, a control panel 22 on which the operation and the selection buttons are arranged, and a central processing unit (CPU) main body 23. The CPU main body 23 is equipped through a connector 24 with the cassette 12 which has the computer-readable storage medium 15 illustrated in FIG. 2.

Specifically, the CPU main body 23 is provided with a CPU core 26, a port 27 between the CPU core 26 and the control panel 22, a random access memory (RAM) 28 connected to the CPU core 26, and a read-only memory (ROM) 30 connected to the CPU core 26. The illustrated CPU core 26 is connected to a timing, address, and data buffer (simply called a buffer) 31 and is also connected to the connector 24 through a bus. In addition, a display driver circuit 35 is placed between the CPU core 26 and the LCD panel 21 and is connected through a display RAM interface 40to a display RAM 42 which stores image data, such as characters and items, to be displayed on the LCD panel 21.

Moreover, the illustrated portable game machine has a communication control portion 50 which is connected to the CPU core 26 and which includes an communication control interface. The communication control portion 50 is connected through a connector therein to another portable game machine, as shown in FIG. 1B. Herein, it is to be noted that the ROM 30 stores an operating system (OS) for controlling the LCD panel 21, the display driver circuit 35, the communication control portion 50, and the like.

In FIG. 3, it is assumed that the cassette 12 for the card game according to this invention is connected through the connector 24 to the CPU core 26 and power is on or a reset operation is executed. Under the circumstances, the CPU core 26 starts the OS stored in the ROM 30 and initializes the whole of the portable game machine. In this event, the card game program stored in the computer-readable storage medium 15 of the cassette 12 is developed into the RAM 28 and the display RAM 42. The RAM 28 is operated as a main memory. Thereafter, the CPU core 26 executes the card game program in accordance with the commands given by the player and displays image data on the LCD panel 21.

Practically, when the commands are given by the player with reference to the image displayed on the LCD panel 21, the display RAM 42 is accessed through the display interface 40 to read the characters or items corresponding to the commands. The characters or items are displayed on the LCD panel 21.

Referring to FIGS. 4 through 9, description will be made about cards which are used in the card game according to this invention. At first, the card game according to this invention prepares various cards of 350 species each of which is composed of 99 sheets. Therefore, the total number of the cards is equal to 34650. Card data related to all of the cards of 34650 sheets are previously stored in the data area 152 of the computer-readable storage medium 15 but can not always be used by all players. In other words, only a restricted number of cards can be used in common to all players, although the restricted number of the cards can be changed or increased when a predetermined condition is cleared by the players.

Under the circumstances, at least a part of the card data is transferred to the CPU main body 23 and stored in the RAM 28.

Now, the card game according to this invention will be schematically described for a better understanding of this invention. In the card game, each player alternately puts each card on a playing field or a prescribed field defined on the LCD panel 21. The card game is advanced in such a manner that a decision is made as regards strength and weakness of both the cards put on the playing field and a weaker player's life point is decreased. One feature of the card game according to this invention is that each player can designate an "attack" or a "defense" on each card arranged on the playing field of the LCD panel 21 and that such an attack and a defense can be also designated on one-to-multiple cards arranged on the playing field. As a result, various competitions or matches, such as one to a plurality of cards, can be enjoyed in the card game.

Another feature of the card game according to this invention is to prepare, among the cards of 350 species, six kinds of field cards which decide playing fields or competition fields defined in the card game. More specifically, the field cards according to an embodiment of this invention are composed of a forest card representative of a forest, a wilderness card representative of a wilderness, a mountain card representative of a mountain, a grassland card representative of a grassland, a sea card representative of a sea, and a darkness card representative of a darkness. Consequently, each player can designate seven fields along with a normal field or a usual field.

Moreover, the remaining cards except the field cards are classified into creature or monster cards of 300 species and rear support or magic cards of forty-four species. Herein, it is to be noted that each of the monster cards has an ability and an attribute predetermined for each monster card and that each of the magic cards has a special effect on a specific condition determined for each magic card.

The abilities of the monster cards are specified by attack ability points and defense ability points. Still another feature of the card game according to this invention is that the attack and the defense ability points of the monster cards are varied in dependency upon the competition environments determined by the field cards.

Referring to FIG. 4, illustration is partly made about a list of the monster cards which are individually given names particular to the monster cards in consideration of the attributes and the like of the monsters. However, the names of the cards in FIG. 4 are symbolized by A00 to J09 for brevity of description. As mentioned before, three hundred species of the monster cards are practically prepared in the card game.

As readily understood from FIG. 4, each monster card has the attack and the defense ability points which are varied in each of the competition environments. Thus, both the attack and the defense ability points may be collectively referred to as field ability points. In addition, it is to be noted that the attack and the defense ability points are different from each other in most of the monster cards illustrated in FIG. 4.

The card list illustrated in FIG. 4 is stored in the form of a table in the partial data storage area 153 of the data area 152 illustrated in FIG. 2. This means that the partial data storage area 153 stores, as the field ability point data, the competition environments and the attack and the defense ability points. In other words, the field ability point data for the monster cards are stored in files (may be specified by mxxx) which are assigned to the respective monster cards and which are prepared in the partial data storage area 153 in the computer-readable storage medium 15. At the beginning of the card game, the files are partly transferred to the cassette 12 to the RAM 28 in the portable game machine and are stored in the RAM 28.

As mentioned before, it is possible to make a fun of the card game by varying the ability points of the cards in every competition environment and by changing the attack and the defense ability points from each other in each field.

The cards enumerated in FIG. 4 can be used on an attack side or a defense side in all of the competition environments which include the normal field. In this connection, each player can play the card game by designating either the attack side or the defense side. For example, the uppermost card A00 shown in FIG. 4 has the attack ability point of 3000 and the defense ability point of 2500 in the normal field but has the attack ability point of 3300 and the defense ability point of 2500 in the forest field. Likewise, the other cards have different attack and defense ability points in the different fields.

As is apparent from FIG. 4, the cards include various types of cards. For example, a certain card has a high defense ability point when it is used on the defense side but a low attack ability point when it is used on the attack side. To the contrary, another card has a low defense ability point on the defense side but a high attack ability point on the attack side. Thus, wide variety of ability points are allocated to the respective monster cards. Accordingly, the card game can be enjoyed in various manners without increasing the number of the monster cards.

Figure 5:
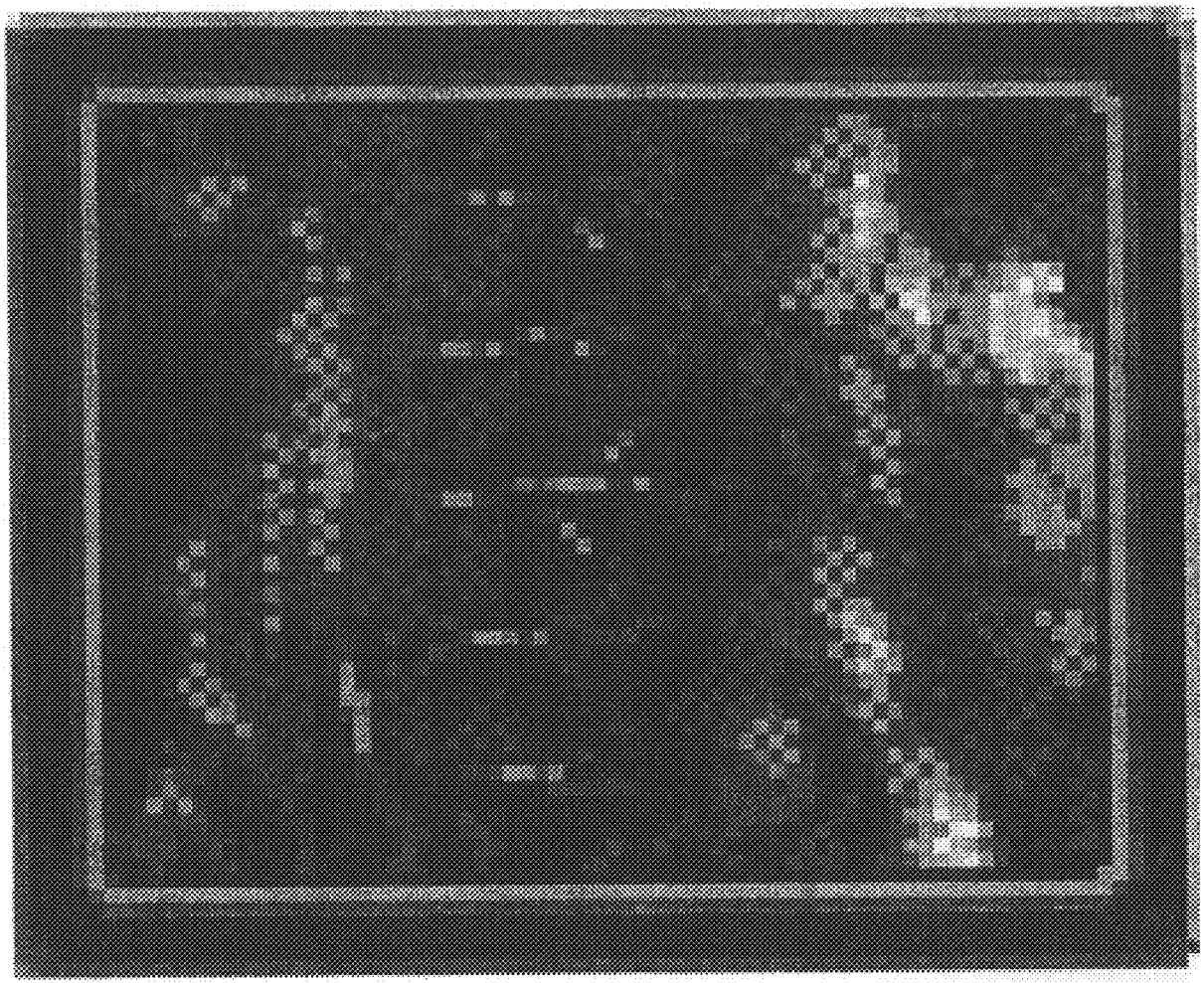
FIG. 5 shows an example of a field card peculiar to the card game according to this invention.
Figure 6:
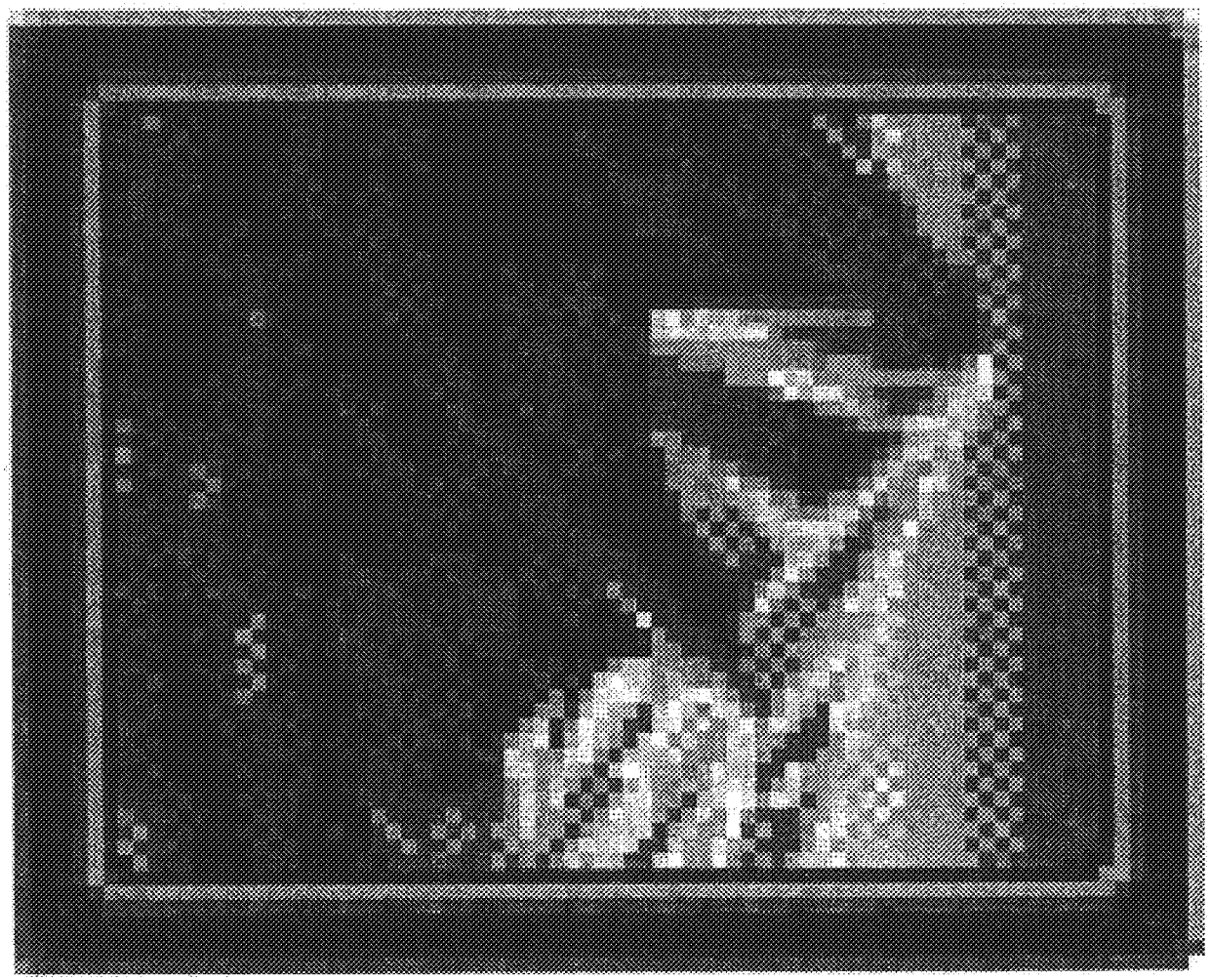
FIG. 6 shows another example of a field card peculiar to the card game according to this invention.

Referring to FIGS. 5 and 6, the forest card and the mountain card are exemplified which represent the forest field and the mountain field, respectively, among the above-mentioned cards. When such a field card is put in the playing field by a player, the competition environment becomes a field determined by the field card and the attack and the defense ability points of each monster card are changed in accordance with the field determined by the field card.

As will become clear as the description proceeds, the competition environment is determined at random at the beginning of the card game. Thereafter, it is possible to determine the field by putting the field card in the playing field on a first attack side.

Figure 7:
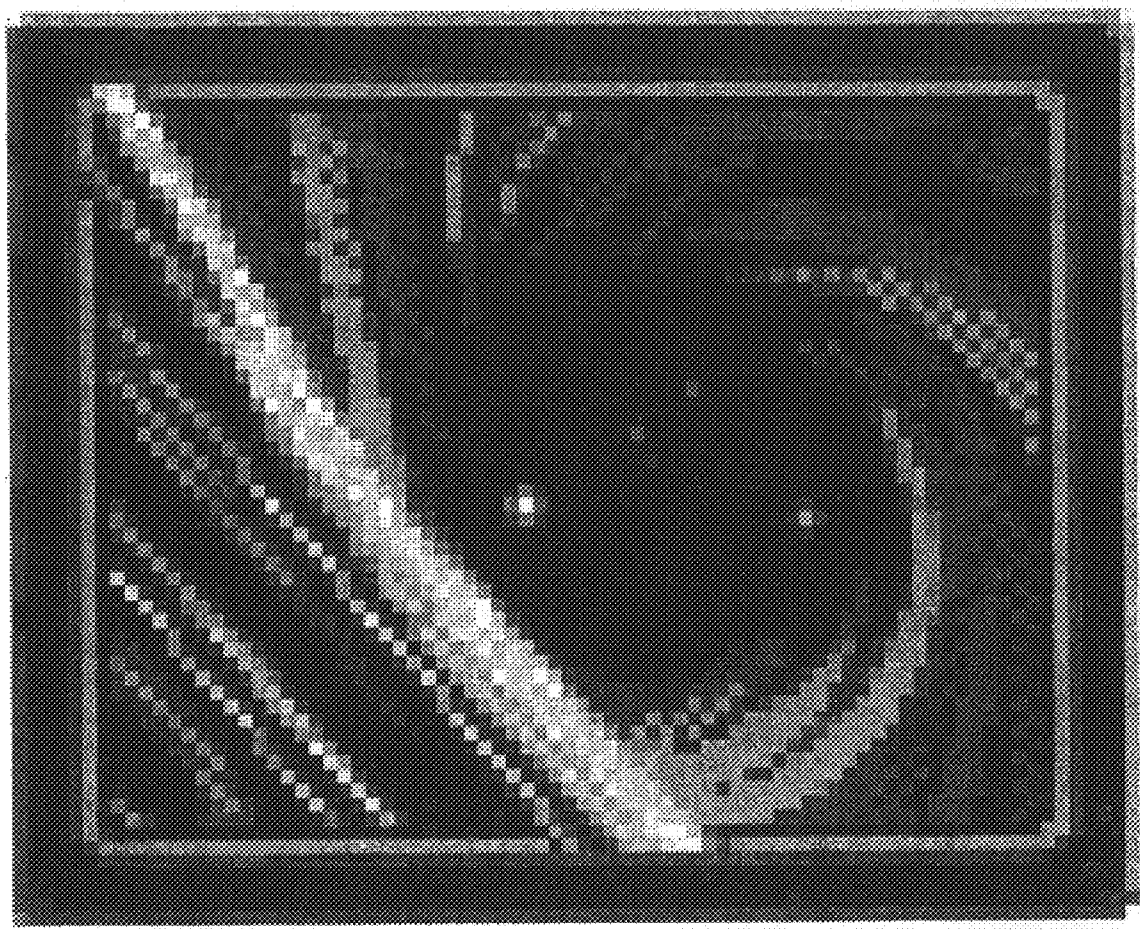
FIG. 7 shows an example of a special effect card or a magic card used in the card game according to this invention.

Referring to FIG. 7, illustration is made about a black hole card which serves as one of the magic cards. As mentioned before, such a magic card brings about a special effect which is assigned to each magic card. The special effect influences the monster cards in the playing field, the life points of the players, or the like. The black hole card shown in FIG. 7 can remove, from an image of the LCD panel 21, all cards arranged in the playing field. As a result, the cards disappear from an image of the LCD panel 21.

Figure 8:
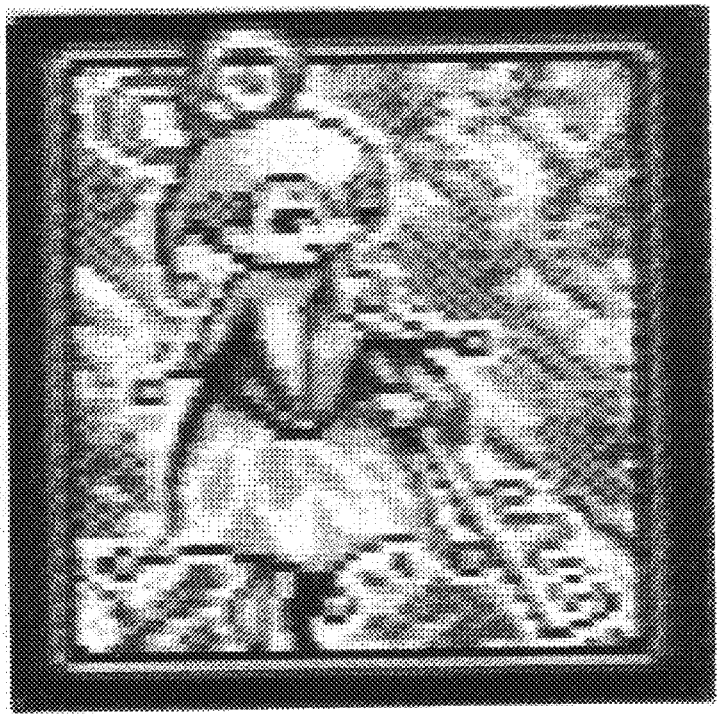
FIG. 8 shows an example of a creature card or a monster card used in the card game according to this invention.

Referring to FIG. 8, one of the monster cards is illustrated that is given the name of "elf" and that has the attack ability point of 400 and the defense ability point of 300 in the normal field.

Figure 9:
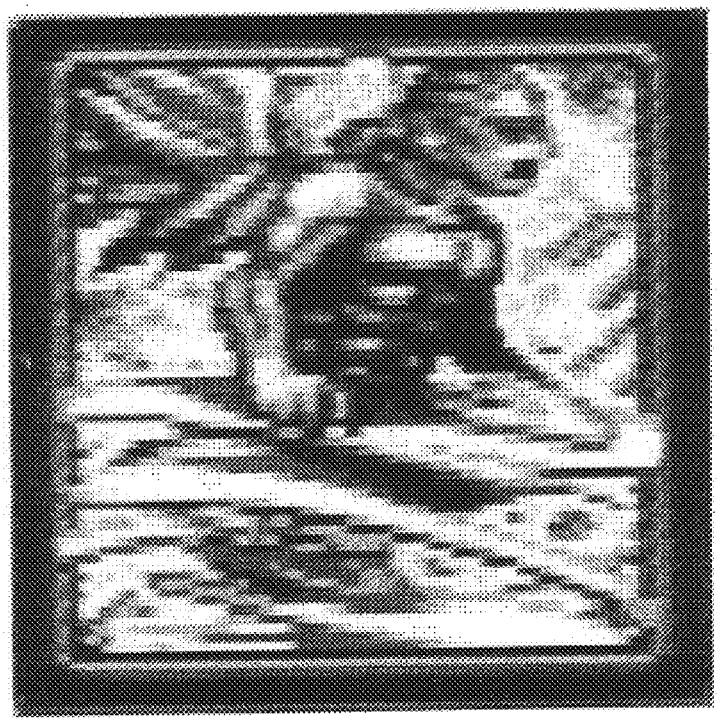
FIG. 9 shows another example of another creature card or monster card used in the card game according to this invention.

Referring to FIG. 9, another one of the monster cards is named a guardian of wind, namely, a jinn and has the attack ability point of 700 and the defense ability point of 900.

Referring to FIGS. 10 to 20, description will be made about the card game according to this invention. As mentioned before, the card game may be played such that each player competes with the computer operated in accordance with the card game program transferred to the CPU main body or competes with the other player connected through the communication cable.

At first, the cassette 12 is loaded into the portable game machine prior to a start of the card game. In this event, the card game program is partially transferred from the computer-readable storage medium 15 to a predetermined area of the RAM 28. The following processing is executed under control of the CPU core 26 in accordance with the card game program, although detailed description will be made about the CPU core 26. Therefore, the CPU core 26 may be called a processing unit or an executing unit for executing the card game program.

In the meanwhile, the cards of each player is kept in a desired reservoir zone of the RAM 28 that may be referred to as a bag. In the embodiment according to this invention, it is assumed that the bag is previously loaded with three-hundreds (300) cards selected from the cards of 34650 at the beginning of the card game. However, it is to be noted that the number of the cards in the bag can be increased or decreased on the basis of competition results obtained by competing with the other player or players through the communication cable. In addition, the cards kept in the bag may be exchanged to the other player by communication. Moreover, each initial combination of the cards (300 in number) in the bag may be changed at every one of the cassettes.

Figure 10:
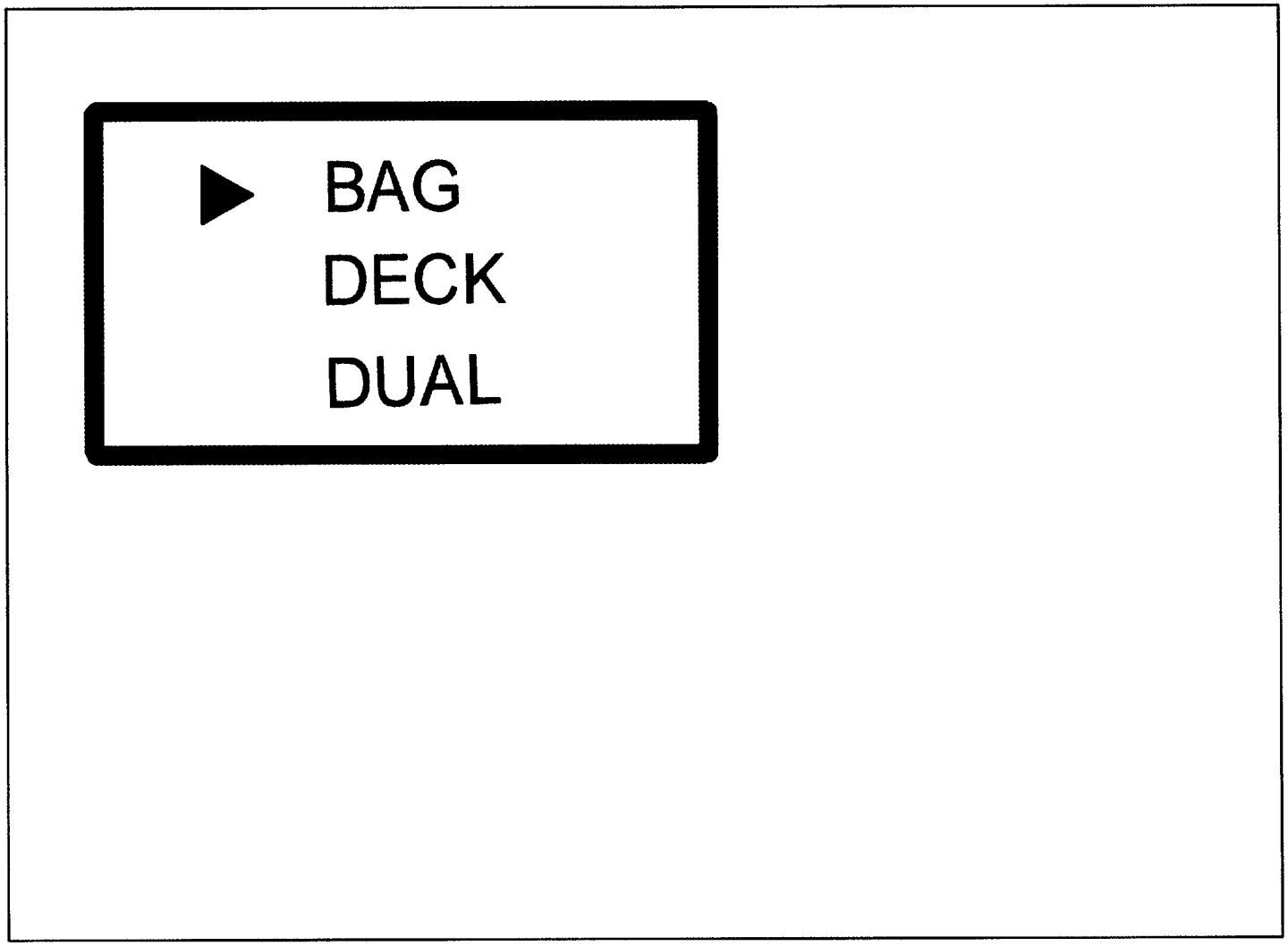
FIG. 10 shows a display image displayed on execution of the card game according to this invention.

At the start of the card game, the player who is possessed of the portable game machine selects either the competition with the computer or the competition with the other player. The computer or the other player will be called an opponent player. After the selection is executed by the player, an image or a picture illustrated in FIG. 10 is displayed on the LCD panel 12. As shown in FIG. 10, the image includes the displays of "bag", "deck", and "dual" and a triangular cursor is placed at a leading portion of the bag. When the display of the bag is selected by the player, contents of the bag are successively displayed in a manner to be described later. On the other hand, when the display of the deck is selected by moving the triangular cursor and by pushing the control button by the player on the control panel, forty cards are extracted from the bag to form a card deck in a manner to be described later. In addition, the card game is practically started by selection of the display of the dual.

Figure 11:
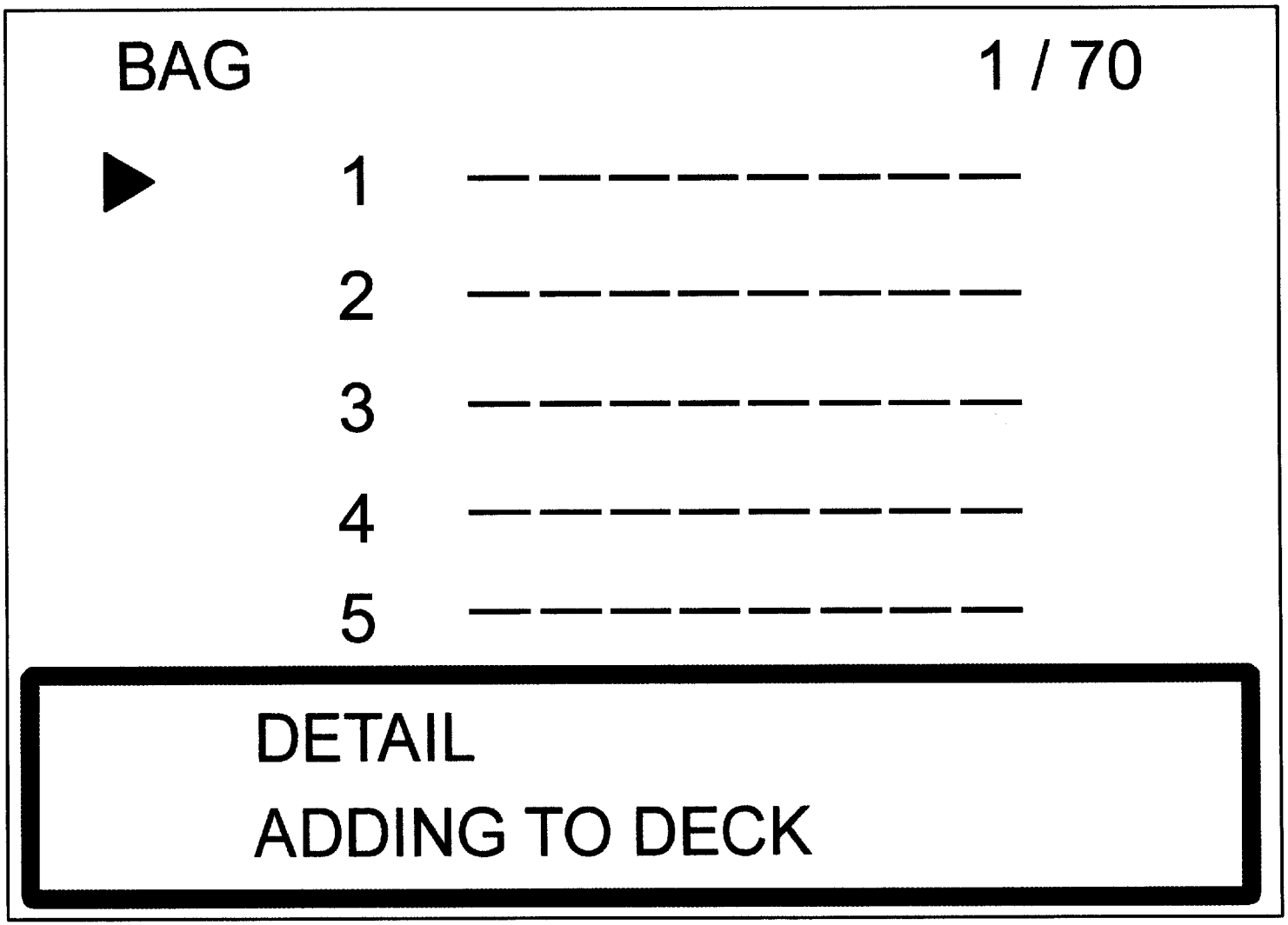
FIG. 11 shows another display image appearing at a next stage following the stage shown in FIG. 10.

Herein, it is assumed that the bag is selected from the image illustrated in FIG. 10 and the image of FIG. 10 is changed to a bag content display image as illustrated in FIG. 11. The bag content display image is composed of first through seventieth pictures, as readily understood from the right uppermost indication (1/70). The first picture illustrated in FIG. 11 is for displaying first through fifth ones of the cards. In the illustrated example, the first through the fifth cards are not present in the bag of this player, which shows that the player does not own the first through the fifth cards. As the first through the fifth cards, the cards A00 to A04 illustrated in FIG. 4 may be arranged and the card names are displayed together with the number of each card when each of the first through the fifth cards is possessed of the player.

Next, the player can move to the second picture by scrolling the triangular cursor or by changing the pictures from one to another. As a result, the second picture appears on the LCD panel 21 and displays cards corresponding to the sixth through the tenth cards, the names, and the number of the cards, if any. Thereafter, similar operation is repeated until the seventieth picture is displayed on the LCD panel 21. By displaying the seventieth picture, the contents in the bag are displayed until 350-th one of the cards, together with the names and the numbers. Thus, the player can know of all the cards held in the player's bag.

Referring back to FIG. 10, the indication of "detail" is displayed on the lower part of the picture. When the indication of the detail is selected by the player, the attributes and the ability points are displayed in detail about the corresponding card. When the indication of "adding to deck" is selected, the card in question is moved from the bag to the deck.

In FIG. 10, let the indication of the deck be selected by the player. In this event, the player can voluntarily select forty cards from the bag to add the selected cards to the player's deck. Thus, the card deck of forty cards is formed by the player. In the above-mentioned description, although the card deck is assumed to be voluntarily formed by each player, such a card deck may be automatically formed under control of the card game program. In the latter case, the card deck is formed regardless of the player's intention and, therefore, the player can not recognize the contents of the player's deck. In this situation, the card game is started.

Figure 12:
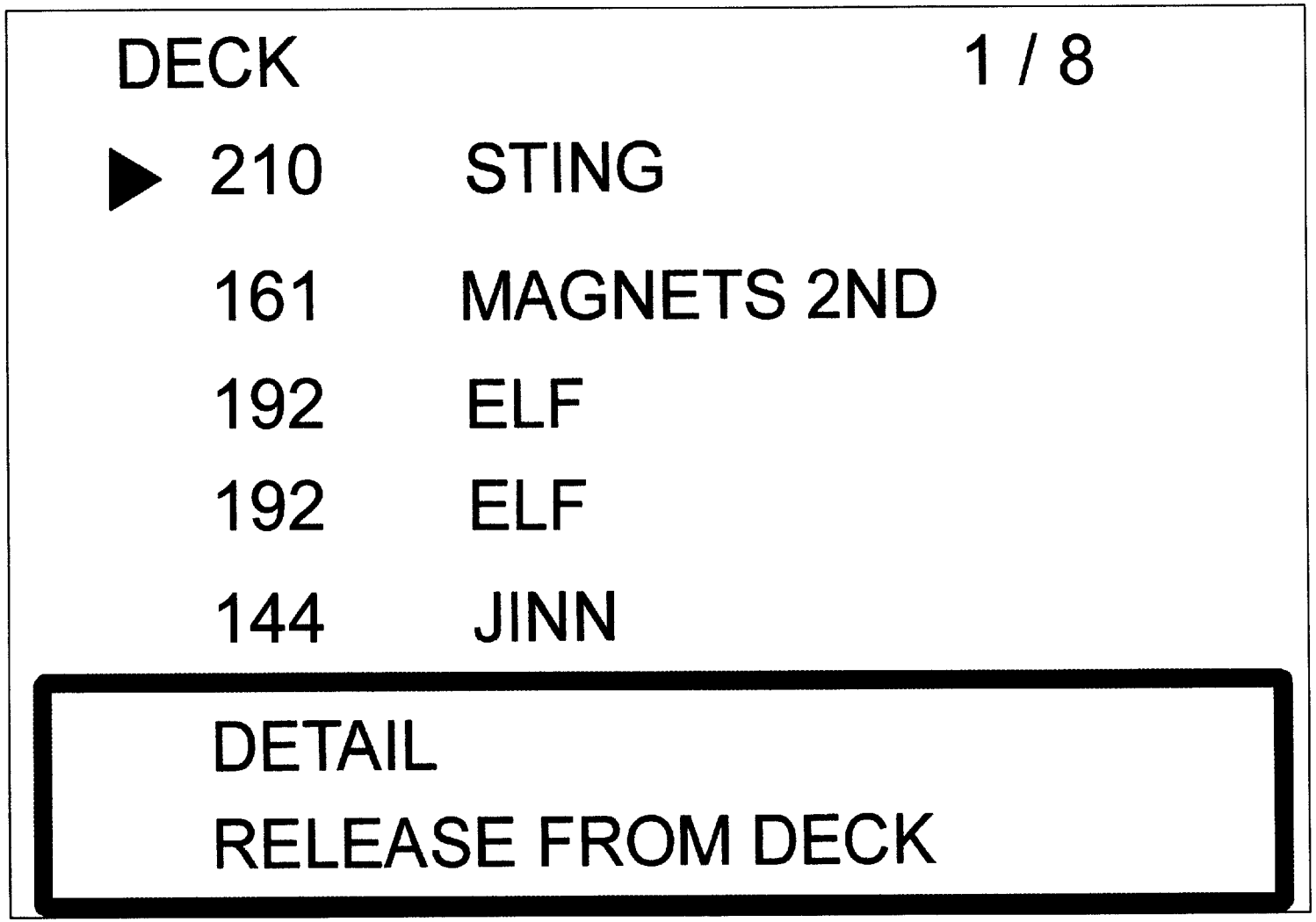
FIG. 12 shows a next display image appearing after the stage illustrated in FIG. 11.

Referring to FIG. 12, the cards on hand in the player's deck are displayed as a deck display image on the LCD panel 21. In FIG. 12, the deck display image is divided into first through eighth partial deck images, as readily understood from the right uppermost indication of (1/8), and the first partial deck image is shown in FIG. 12.

As is apparent from FIG. 12, the card numbers and the corresponding names are displayed on each of the partial deck images. In the illustrated example, the card deck is provided with the cards of the card numbers 210, 161, 192, 192, and 144 which are named "sting", "magnets second", "elf", "elf", and "jinn", respectively. Thus, a plurality of the same cards, like in "elf" in FIG. 12 may be included in the card deck.

Further referring to FIG. 12, the indication of "detail" shown at a lower part is for displaying the attributes and the ability points in detail when it is selected by the player. On the other hand, the indication of "release from deck" is for releasing the corresponding card from the card deck to turn it back to the bag.

In a like manner, it is possible to successively switch the partial deck images and to display to the eighth partial deck image. Thus, the player can confirm the forty cards on hand kept in the card deck. Although description has thus far been made only about one of the players, it is needless to say that another player also prepares the card deck of forty cards in a similar manner.

When both the players prepare the card decks in the above-mentioned manner, the player competes or fights with another player that may be, for example, the computer and the card game is started between both the players. In other words, both the players are put into a competition or fighting state.

In the competition state, five cards are selected at random from the card deck of each player under control of the computer and are arranged in specific zones displayed on the LCD panel 21. In this event, each card arranged in the specific zones is placed inside out. The specific zones are determined at a lower and an upper side of a displayed image or screen that may be assigned to the player and another player, respectively, and which are opposed on the displayed image with a center zone kept between the lower and the upper zones. The five cards arranged in each of the specific zones may be collectively called a hand or may be called hand cards.

Figure 13:
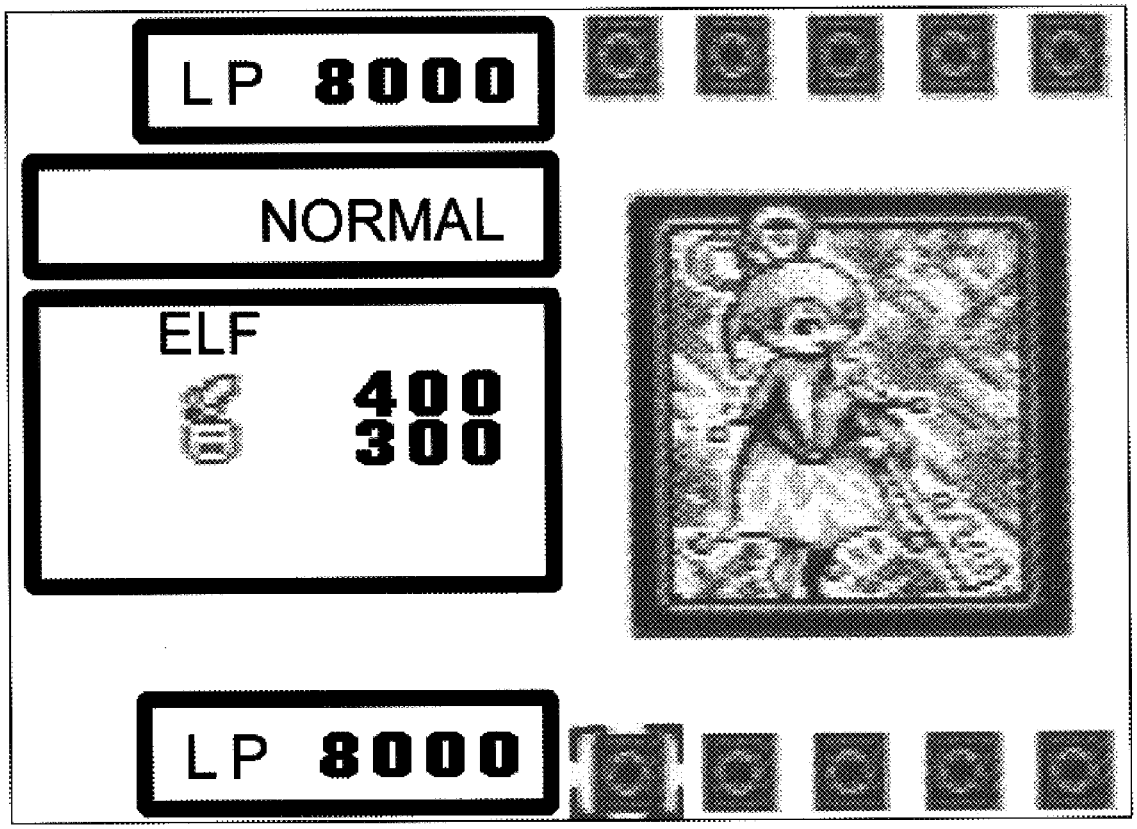
FIG. 13 shows a start image appearing at a start of the card game according to this invention.

Referring to FIG. 13, the five hand cards are arranged face down in the specific zones. It is surmised in FIG. 13 that the lower and the upper ones of the specific zones are allocated to the player having the portable game machine and the opponent player which may be, for example, the computer, respectively. In FIG. 13, a life point (LP) of the player is displayed on a lower side area and is now equal to 8000 while a life point (LP) of the opponent player is also displayed on an upper side area and is also equal to 8000. The player can see each card placed face down by selecting each card by a cursor of a rectangular shape and by facing it up. The faced-up card can be seen only by the player but can not be seen by the opponent player.

In FIG. 13, the cursor of the rectangular shape (depicted by a broken line) surrounds the leftmost card in the lower specific zone and, as a result, the leftmost card is faced up at the center zone between the specific zones. In the illustrated example, the faced-up card is named "elf" card and has the attack ability point of 400 and the defense ability point of 300, as shown in FIG. 13. Thus, the attack and the defense ability points are displayed along an upper row and a lower row in a left side of the center zone which may be referred to as a name and ability display portion. In addition, it is also understood that the game environment is normal, as shown in a portion placed over the name and ability display portion.

The player in question can successively see each card one by one, by moving the cursor and by facing it up. In consequence, the player can know of the hand cards and their ability points.

Figure 14:
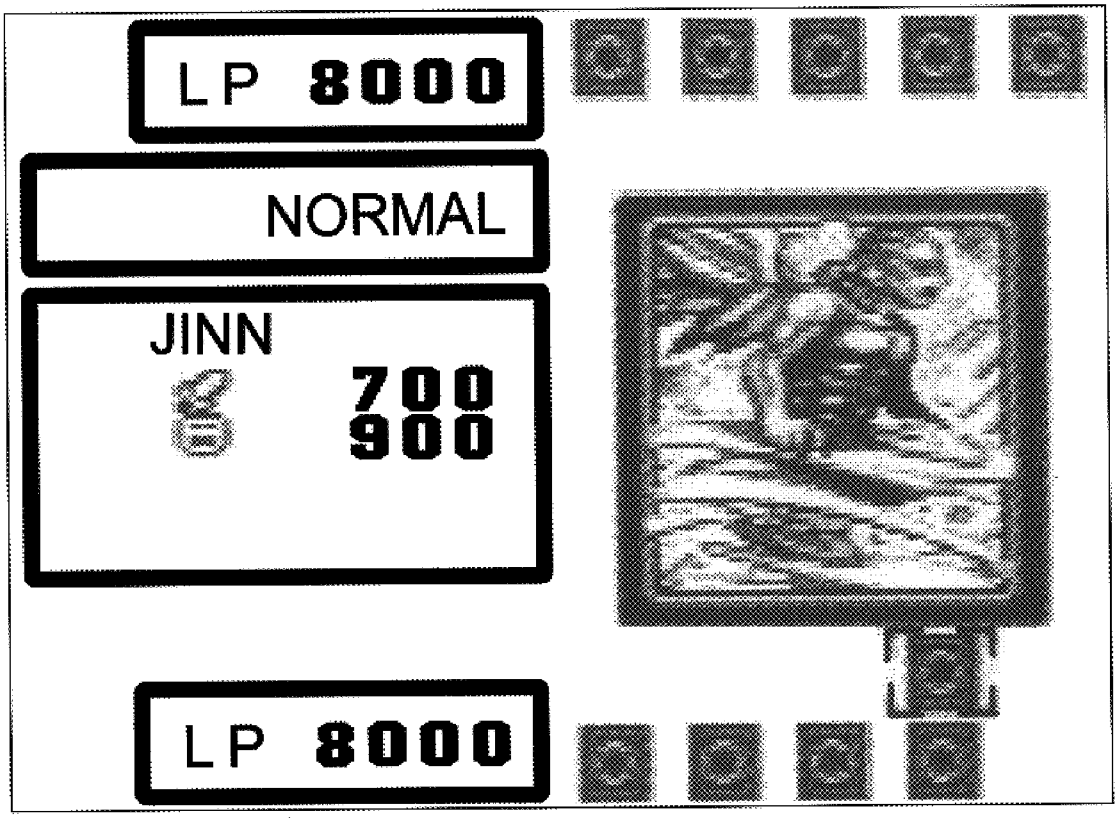
FIG. 14 shows a display image appearing at a stage after the stage illustrated in FIG. 13.

Referring to FIG. 14, the player who takes up a position on the lower side of FIG. 14 selects, as a competition or fighting card, a rightmost one of the hand cards by moving the cursor and puts the competition card at an upper area which is located over the specific zone for the player and which may be called a competition or fighting area. In this connection, an inside area between both the specific zones may be referred to as the fighting or competition area.

As illustrated in FIG. 14, the card which is put in the fighting area is faced up and can be seen by the player. However, the opponent player can not see the card selected by the card because the card is not faced up on the LCD panel of the opponent player.

In the example illustrated in FIG. 14, the card selected by the player is named "jinn" and has the attack ability point of 700 and the defense ability point of 900 in the normal environment or field.

Thus, the player puts or summons the selected card into the fighting or playing field. In this state, either the player or the opponent player designates either the attack or the defense. When the attack is designated by the player, the selected card in the playing field becomes a rectangular shape long along a vertical direction, as shown by the card surrounded by a broken line in FIG. 15. On the other hand, when the defense is designated by the player, the selected card in the playing field is displayed in a rectangular shape long along a horizontal direction, as illustrated in FIG. 16.

Herein, it often happens that a plurality of cards are left in the playing field. For example, when both the players continuously designate only the defense in conjunction with each card summoned into the playing field, the monster cards are increased in the playing field at every turn of each player. In addition, when either one of the players continuously get wins, the cards in the playing field of the one player are also increased.

When the plurality of the cards are left in the playing field of either one of the players, it is possible to designate either the attack or the defense at every one of the cards.

Figure 15:
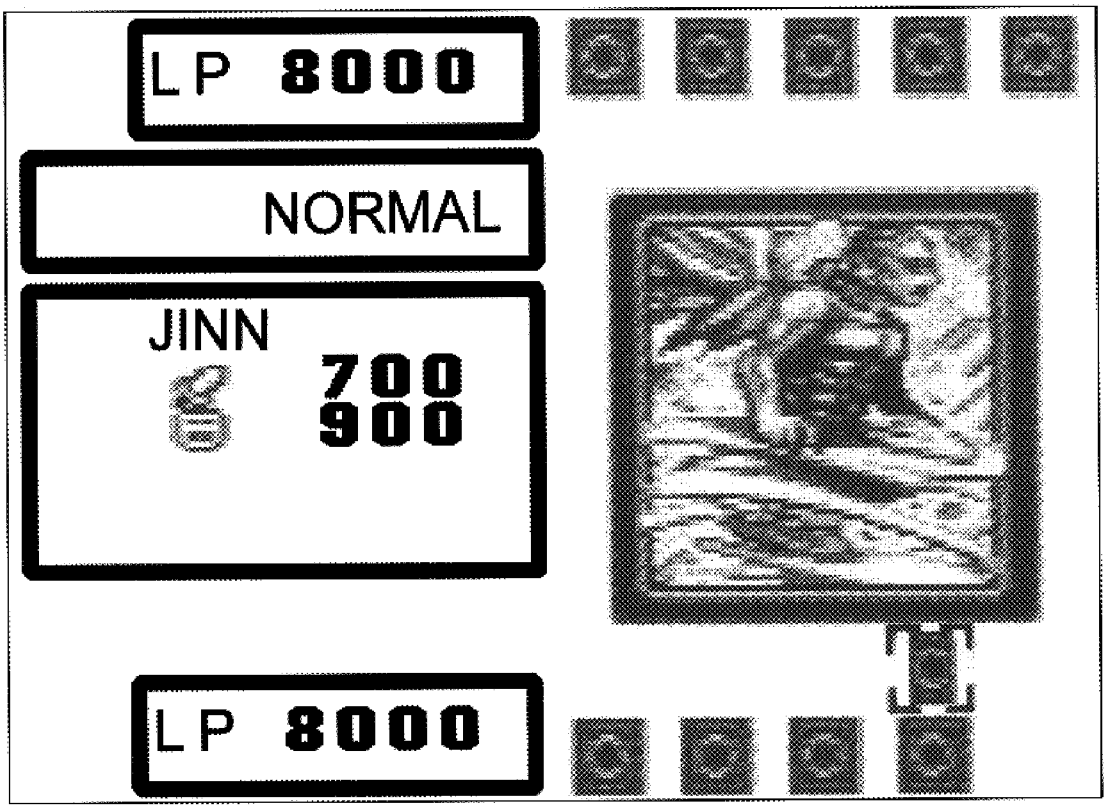
FIG. 15 shows a display image appearing when attack is selected at the stage illustrated in FIG. 14.
Figure 16:
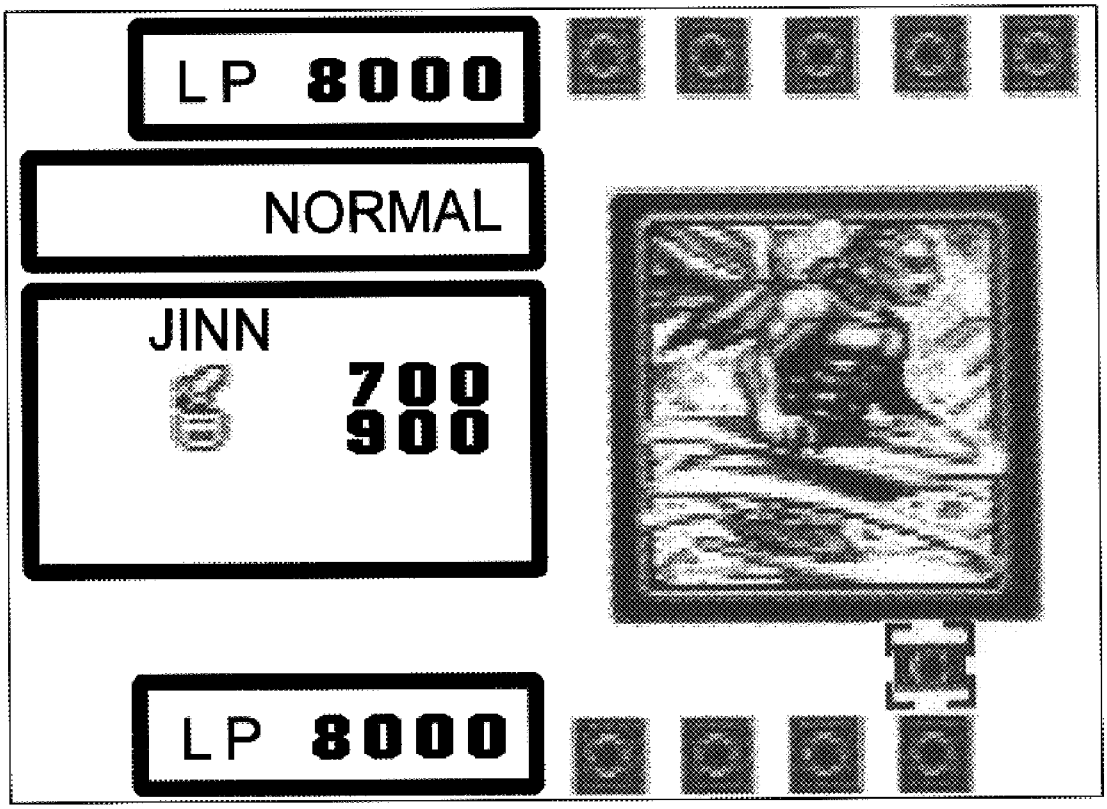
FIG. 16 shows a display image appearing when defense is selected at the stage illustrated in FIG. 14.

In the state illustrated in FIG. 15 or FIG. 16, the opponent player also summons the selected card into the playing field and the attack is designated by either one of the players. As a result, both the cards are put into a fighting or competition state and the fight or competition is started between the player and the opponent player in a manner illustrated in FIG. 17. This fight is executed in accordance with an algorithm which will be described later in detail. When the selected card is summoned into the playing field, a single card is supplemented in the specific zone.

Figure 17:
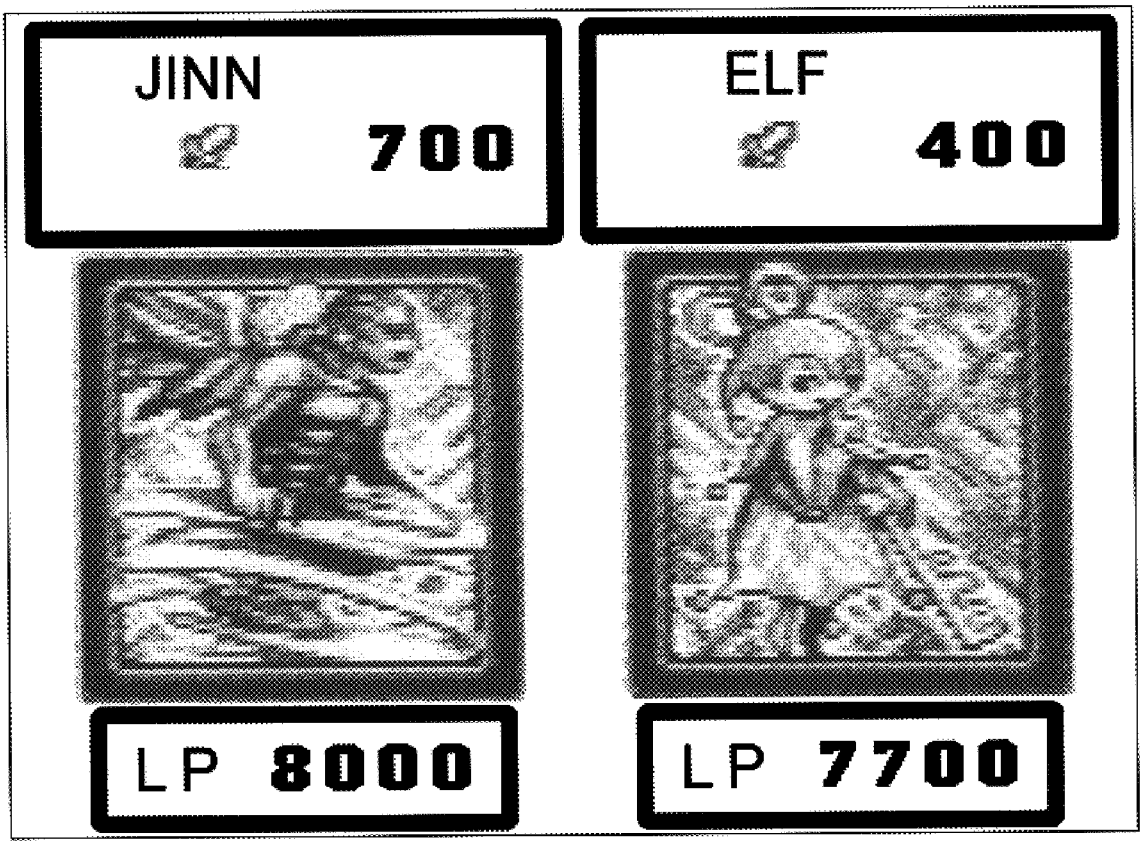
FIG. 17 shows a display image for use in describing a fighting state of the card game according to this invention.

Referring to FIG. 17, description will be made about the fighting state on the assumption that the player selects the card of "jinn" illustrated in FIG. 14 while the opponent player selects the card of "elf" illustrated in FIG. 15. In the illustrated example, the fight is held on the condition that both the player and the opponent player select the attack.

The card of "jinn" has the attack ability point of 700 in the normal field or environment, as shown in FIG. 14, while the card of "elf" has the attack ability point of 400 in the normal field, as shown in FIG. 13. Accordingly, the player who summons the card of "jinn" in the playing field or area wins the opponent player who summons the card of "elf" in the playing field. A difference between the attack ability points of "jinn" and "elf" is equal to 300 points and is subtracted from the life point (LF) of the opponent player. In consequence, the life point (LF) of the player in question is kept unchanged and is equal to 8000 while the life point (LF) of the opponent player is reduced to 7700.

After completion of the fight, an image similar to FIG. 15 is displayed again. However, it is to be noted that the card which won the fight is faced up and left in the playing field and that the card which lost the fight disappears from the image. When the opponent player puts a plurality of the cards in the playing field and the player selects the attack, the player which selects the attack designates either one of the cards to be attacked by the player.

After the fight finishes one time, a single card is supplemented in each of the specific zones from the decks of the player and the opponent player. Similar fights are repeated until the life point (LF) of either player is reduced to zero and the card game is ended. Thereafter, a card is selected from the deck of a player who lost the card game and is moved or transferred to the deck of another player that won the game.

The above description has thus far been made about the fight in the normal field. However, the card game according to this invention prepares seven competition environments or fields and the attack ability point and the defense ability point of each monster card are changed at every competition field, as mentioned before.

In addition, the card game prepares a combination function such that superposition of two cards brings about another different card. Such a combination will be called merging because two cards are merged into another single card. On merging, two cards summoned in the playing field are superposed on each other and disappear from a screen and, instead, another different card appears on the screen.

Furthermore, a trap card may be also prepared as one of the magic cards and serves to make the opponent temporarily stop the attack/defense.

Figure 18:
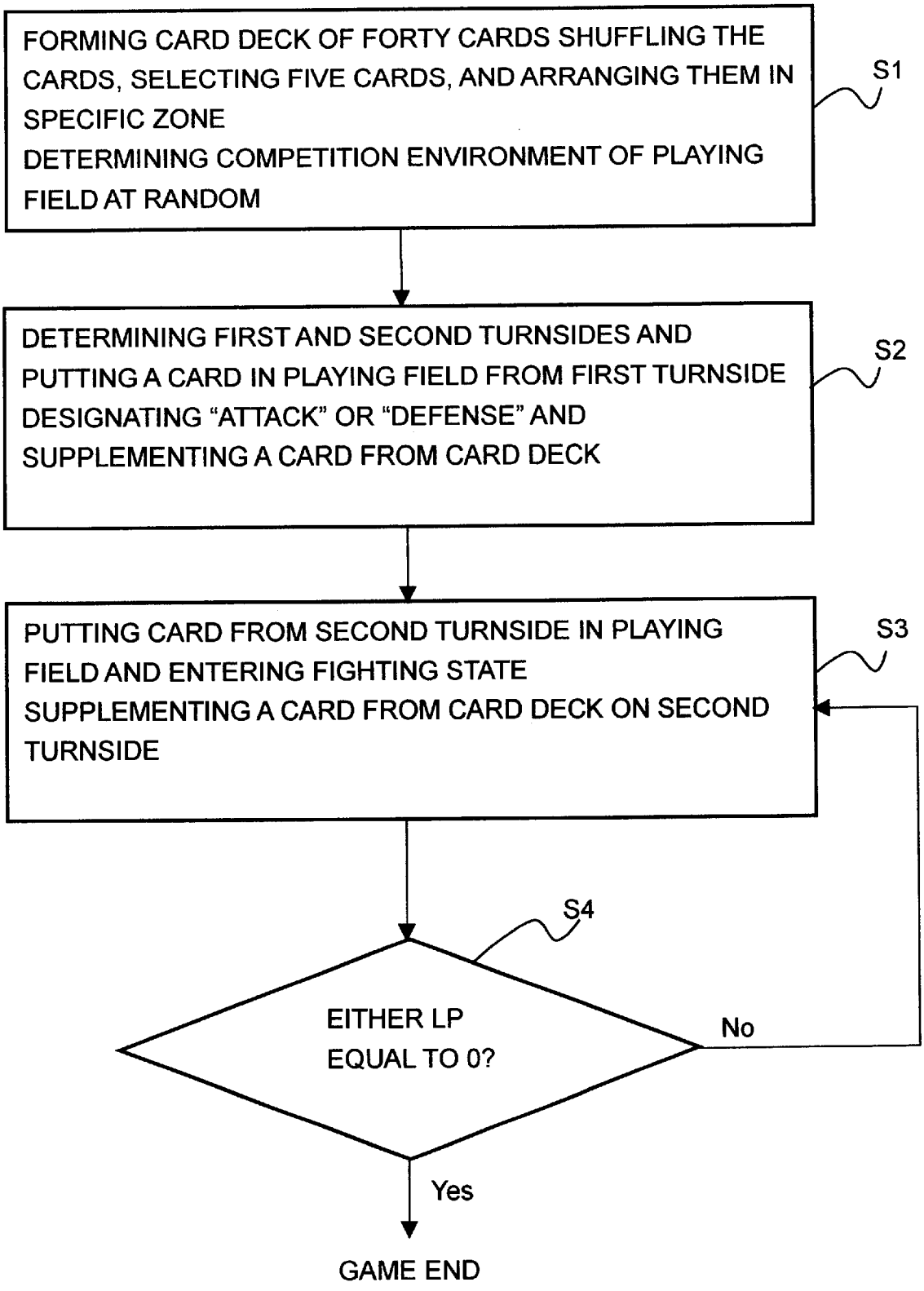
FIG. 18 shows a flow chart for use in describing an operation of the card game according to this invention.
Figure 19:
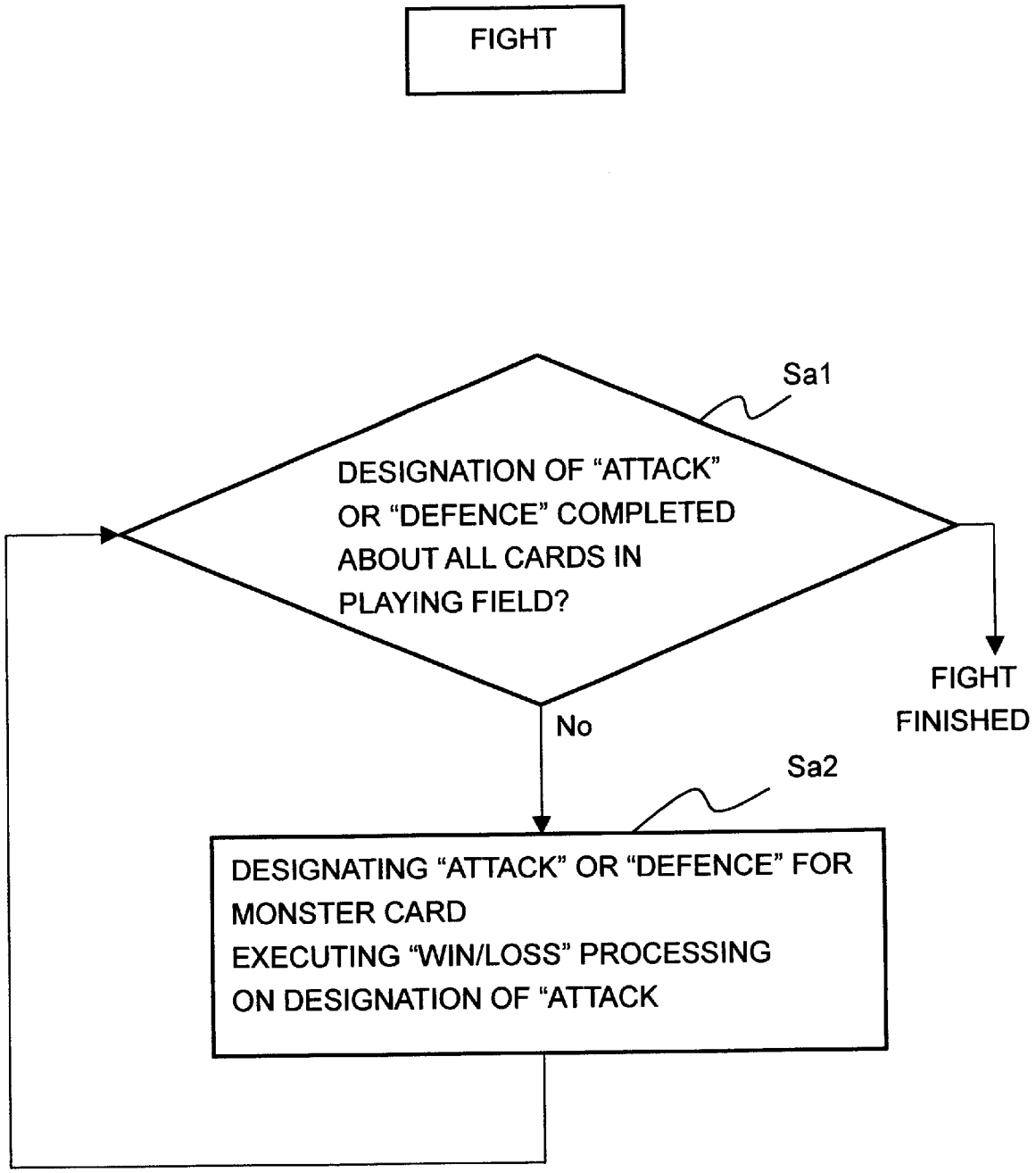
FIG. 19 shows a flow chart for use in describing a processing operation carried out in the fighting state.
Figure 20:
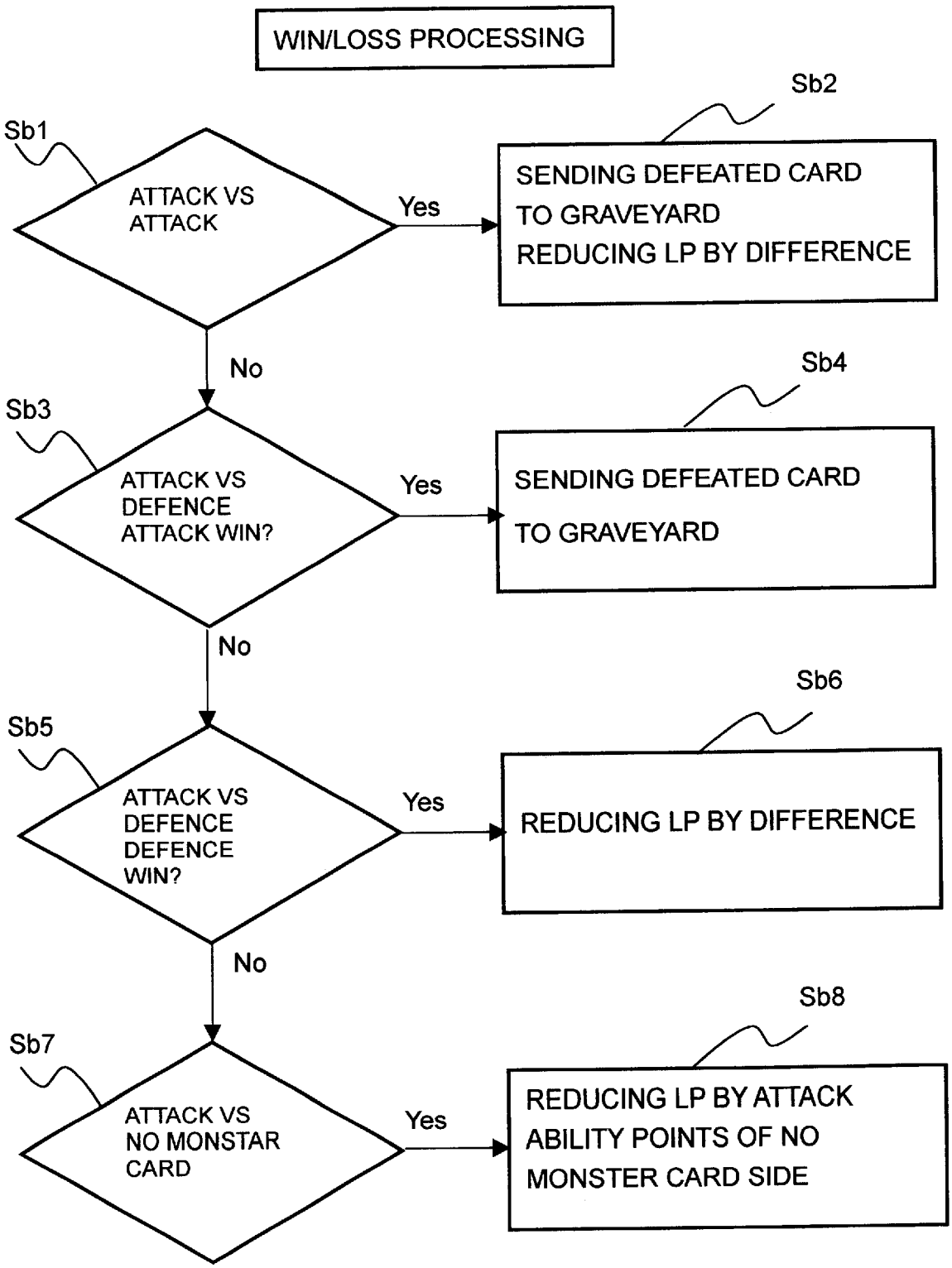
FIG. 20 shows a flow chart for use in describing a processing operation carried out to determine wins or losses.

Referring to FIGS. 18 to 20, a procedure of the card game according to this invention will be described more in detail hereinafter. As shown at a step S1 in FIG. 18, forty cards are at first selected from the bag to form a card deck and are shuffled. From the card deck, five cards are selected or extracted and are arranged as hand cards in each of the specific zones, as shown in FIG. 13. This means that five hand cards are selected from the card deck of the forty cards at random and are arranged in each specific zone. In this state, the competition field or environment is randomly determined by the card game program at this step S1. Thus, provision of the card game is finished.

At a step S2, decision is made about first and second turns related to the player and the opponent player. From the first turn side, a single card is selected in the specific zone and is puts in the playing field. At this step S2, the selection is made about either the attack or the defense and, thereafter, another card is supplemented from the card deck in the specific zone.

At a step S3, the second turn side selects a single card from the five hand cards arranged in the specific zone and puts the single card into the playing field. As a result, the card game proceeds to the fighting state to start the fight or competition between the first and the second turn sides, as exemplified in FIG. 17.

The fight is executed in accordance with the algorithm illustrated in FIG. 19. After completion of the fight, a sole card is supplemented from the card deck of the second turn side and is arranged as the hand cards in the specific zone.

When the fight is finished, the life points (LP) between the first and the second turn sides are compared with each other to judge whether or not either one of the life points (LP) becomes equal to zero, as shown at a step S4. As long as either one of the life points (LP) is not reduced to zero, the step S3 is repeatedly executed.

As shown in FIG. 19, the fight executed at the step S3 begins at a step Sa1 of checking whether or not the selection of either the attack or the defense is made about all of the cards put in the playing field.

When either the attack or the defense is designated about all of the cards summoned in the playing field, the fight is finished, as illustrated in FIG. 19. On the other hand, the step Sa1 is followed by a step Sa2 as long as no designated card is present about either the attack or the defense in the playing field. At the step Sa2, judgement is made about whether or not either one of the cards designates the attack on either the first turn side or the second turn side. When the attack is designated in connection with either one of the cards, processing is executed to determine a win or a loss (a victory or a defeat) and will be referred to as win/loss processing hereinafter.

In FIG. 19, when the attack is not designated in connection with all of the cards arranged in the playing fields, the step Sa2 is succeeded by the step Sa1. At the step Sa1, when the designation of either the attack or the defense is made about all the cards, the fight is finished, as mentioned before.

Referring to FIG. 20, description will be directed to the win/loss processing which is mentioned in conjunction with FIG. 19 and which is executed under control of the CPU core 26 (FIG. 3) in accordance with a card game program stored in the cassette 12. In the win/loss processing illustrated in FIG. 20, judgement is made at a step Sb1 about whether or not both the players designate the attack on their cards put into the playing fields. In other words, it is judged at the step Sb1 whether or not designation is made on both the first and the second turn sides about attack versus attack. In this event, such designation of attack versus attack defines an "attack vs attack" match. When the "attack vs attack" match is specified, the step Sb1 is followed by a step Sb2 at which the attack ability points of the cards on the first and the second turn sides are compared with each other. At the step Sb2, the card which has a higher one of the attack ability points is judged to win while the card which has lower attack ability points is judged to lose. Furthermore, the lost card is discarded in a "graveyard". This means that the lost card disappears from the screen. The life points (LP) on the lost card side are decreased by the difference between the attack ability points of the cards used in the fight. Thereafter, the step Sb2 proceeds to the step Sa1 illustrated in FIG. 19.

Herein, discarding the card in the graveyard means that the card can not be used again until the card game is ended. However, the card discarded in the graveyard is left in the bag and can be therefore used in a following card game. On the other hand, the card which is transferred or moved to the opponent player at the end of the card game is extinct from the bag and is not used in a next card game again.

Referring back to FIG. 20, the step Sb1 proceeds to a step Sb3 when judgement is made at the step Sb1 about no designation of the attack versus attack match. At the step Sb3, it is judged whether or not designation is made about an attack versus defense match on the first and the second turn sides. Moreover, it is also judged whether or not the attack ability points are greater than the defense ability points when the attack versus defense match is designated. When the attack ability points are greater than the defense ability points, the attack side is judged to win and processing is moved to a step Sb4.

At the step Sb4, the lost card, namely, the card on the defense side is discarded in the graveyard. When the defense side is lost, the life points (LP) of the defense side are not decreased and kept unchanged but the cards which can be used by the defense side are reduced in number.

When it is judged at the step Sb3 that the attack versus defense match is designated and the defense side wins, the processing proceeds to a step Sb5. If the defense side wins and the attack side loses, the step Sb5 is followed by a step Sb6 at which the life point (LP) of the lost, namely, attack side is decreased by a difference between the defense ability points and the attack ability points.

If it is judged at the step Sb5 that the attack versus defense match is not selected, the step Sb5 is succeeded by a step Sb7. At the step Sb7, it is detected that, although either one of the first and the second turn sides designates the attack, the other side puts no monster card in the playing field. In this event, the life points (LP) of the other side is decreased by the attack ability points of the card summoned by the one side in the playing field.

Thereafter, the processing is returned back to the step Sa1 illustrated in FIG. 19 to detect whether or not designation of the attack or the defense is made about all of the cards put in the playing field. When the fights are finished in connection with all the cards arranged in the playing field, the processing proceeds to the step S4 which is illustrated in FIG. 18 and which judges whether or not the life points (LP) of either one of the first and the second turn sides become zero. If the life points (LP) of either one of the first and the second turn sides are equal to zero, a single card is randomly selected from the cards held in the card deck of the loser player by the winner player and is transferred from the loser player to the winner player. Such a card to be transferred from a loser to a winner may be initially determined and may be seen by both players. In this case, the card game is executed with the card bet to be transferred.

In the above-mentioned example, the fights on the card game are executed only when the attack is designated or selected on either one of the first and the second turn sides. In other words, no fight is held when the defense is selected on both the first and the second turn sides.

Herein, description will be made about a special operation and a special rule adopted in the card game according to this invention.

As mentioned before, merging or combination can be carried out to obtain a new card by superposing two monster cards. In this case, the two monster cards must be located in the playing field. The merging is very effective when the same monster card was already put in the playing field or when a plurality of monster cards are left in the playing field. If such merging succeeds because a combination of cards is coincident with a predetermined combination for merging, another new card different from the two cards is caused to occur on the screen. Usually, such a new card has ability points higher than those of the two cards before the merging.

If the merging fails, the two cards are sent to the graveyard.

Next, description will be made about processing the field cards. At the step S3 in FIG. 18, let the field card be summoned in the playing field in lieu of the monster cards. In this case, a previous environment of the playing field or area is changed to an environment specified by the field card put in the fighting area. In this connection, the attack and the defense ability points of each monster card are changed to those determined by the field card and the win/loss processing shown in FIG. 19 is executed in accordance with the changed ability points. The changed environment lasts until another field card is put into the fighting area by either one of the players.

This operation will be described with reference to FIG. 4. When a selected one of the field cards is located in the playing field, the attack ability points and the defense ability points determined by the selected field card are read out of the list illustrated in FIG. 4 and are used to play the card game. In other words, the fights are held on the basis of the attack and the defense ability points determined by the selected field card.

On the other hand, let the magic card be located instead of the monster cards in the fighting area at the step S3 in FIG. 18. In this case, the magic card brings about a special effect peculiar to the magic card. In addition to the black hole card illustrated in FIG. 7, any other magic cards may be prepared that modify the ability points of the monster cards and that directly influence the life points (LF) of the player or the opponent player.

When the field card or the magic card is located in the playing field at the step S3 and the monster card or cards remain in the fighting area of each player, the win/loss processing illustrated in FIG. 19 is executed in connection with the monster cards left in the fighting area. Thereafter, operation is carried out in a manner similar to that illustrated in conjunction with the monster cards.

The above-mentioned description has been thus far made on the assumption that only a single card selected from the monster, the magic, and the field cards can be located in the fighting area one by one at every turn of each player. However, a plurality of cards may be put in the fighting area during a single turn. The card game can be advanced by allowing a plurality of cards to be put in the fighting area.

Figure 21:
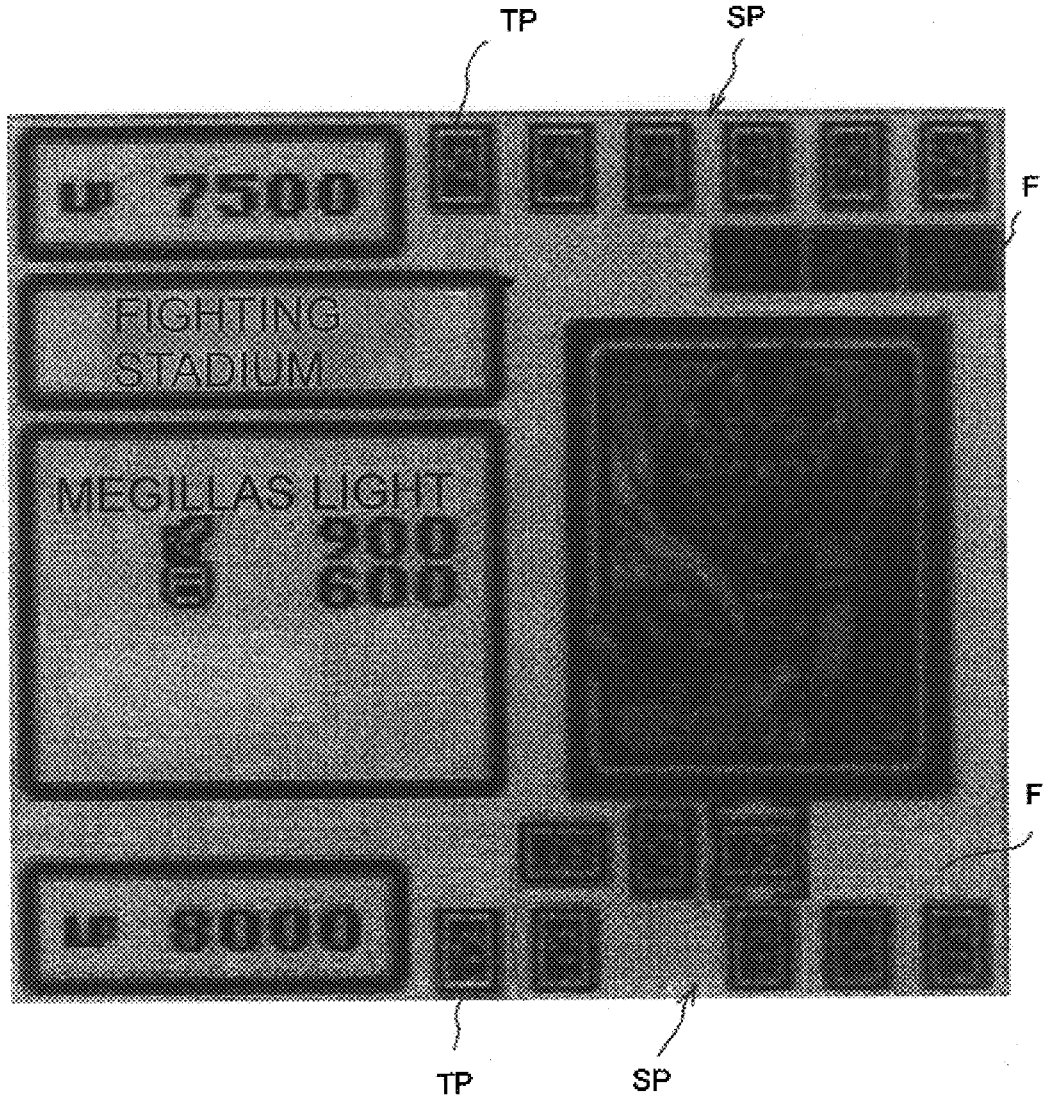
FIG. 21 shows a display image for use in a game machine according to another embodiment of this invention.

Referring to FIG. 21, description will be made about a card game according to another embodiment of this invention which uses a trap card in addition to the magic card. In FIG. 21, it is to be noted that trap card zones TP are determined at portions adjacent to the specific zones for arranging the hand cards and that the trap cards are located in the trap card zones TP by both the players. Each trap card brings about a predetermined effect only when an opponent locates a particular card matched with conditions determined for each trap card.

Herein, the trap cards will be exemplified hereinafter for a better understanding of this invention. One of the trap cards may have a function of rebounding or repelling an attack to reduce the life points of the player who makes the attack while another one of the trap cards may have a function of achieving a victory when an opponent makes an attack by the use of a card which has attack ability points greater than 2000. Alternatively, the other trap cards may be for making the opponent's cards compete with each other and for achieving an effect when the card which is used for an attack has low attack ability points.

Such trap cards are located in each trap card zone TP while the remaining cards are put in the fighting area depicted by F in FIG. 21. Although a player can know the effect of each trap card on putting the trap card in the trap card zone TP in the manner mentioned in conjunction with FIG. 14, an opponent player can not know the effect of each trap card.

Therefore, each player must determine the attack or the defense in consideration of the trap card when the trap card is placed in the trap card zone TP. This serves to make the card game more interesting and thrilling.

In the illustrated example, the magic cards are also prepared and put into an effect when they are located in the specific zones depicted by SP in FIG. 21. Specifically, the magic cards are arranged as the hand cards and bring about the special effect when they are selected in the specific zones SP. Like in the magic cards, the field cards can change the environmental fields from one to another when they are arranged in the special zones SP.

For a better understanding of this invention, the magic cards may be, for example, recovery cards which serve to recover the life points (LP). Using such recovery cards is effective to enjoy the card game in the following manner. It is assumed that one player locates, in the trap card zone TP, a trap card which is effective to obstruct recovery of the life points (LP) in an opponent player even when the recovery card is selected by the opponent player. Under the circumstances, when the opponent player selects the recovery card, the life points (LP) of the opponent player can not be recovered due to the arrangement of the trap card. To the contrary, the life points (LP) of the opponent player can be reduced by the effect of the trap card.

Now, description will be made about operation which is executed when a plurality of cards can be put in the fighting area during a single turn of each player.

Referring to FIG. 21 again, three cards are laid face down in lower and upper ones of the fighting areas F assigned to the player and the opponent player, respectively. The three cards in the lower fighting area F are brighter than the three cards in the upper fighting area F. This shows that the player on the lower side selects each card of the lower fighting area to make it compete with the cards of the upper fighting area. To this end, the player designates either the attack or the defense in relation to each card arranged in the lower fighting area F. Specifically, the leftmost card among the three cards in the lower fighting area is arranged sideways or horizontally while the center card is placed vertically or lengthwise. From this fact, it is readily understood that the leftmost and the center cards designate the defense and the attack, respectively. The rightmost card selected by a cursor drawn by a broken line is arranged sideways like the leftmost card and designates the defense.

In the illustrated situation, no decision has been yet made about an opponent card against the center card which designates the attack in the lower fighting area. This is clear from the fact that the three cards in the upper fighting area F are darkened in FIG. 21.

Thus, either the attack or the defense is decided on an image as illustrated in FIG. 21. The card about which decision of either the attack or the defense was already made becomes bright on the image or screen and, otherwise, the card becomes dark like the cards of the opponent player.

At any rate, it is noted that the above-mentioned operation is executed under control of the CPU core 26 (FIG. 3) in accordance with a card game program stored in the cassette 12 (FIG. 3) and transferred to the RAM 28.

With this structure, each turn of the player lasts until either the attack or the defense is designated about all of the cards arranged in the fighting area. In other words, each turn lasts as long as the dark card is left in the fighting area.

On the illustrated screen, the cursor selects the rightmost card in the lower fighting area. On the center area of the screen, the name of the rightmost card is displayed together with an image of the monster drawn on the card. In the illustrated example, the rightmost card is a monster card named "megillas light" and has the attack ability points of 900 and the defense ability points of 700 in a fighting stadium which is similar to the normal field mentioned in connection with the first embodiment.

The cursor can be freely moved on the screen by the player. This means that the cursor is movable on each of the cards arranged in the upper fighting area to select the opponent's card against each player's card. In addition, the player in question has the life points (LF) of 8000 while the opponent player has the life points (LF) of 7500.

Figure 22:
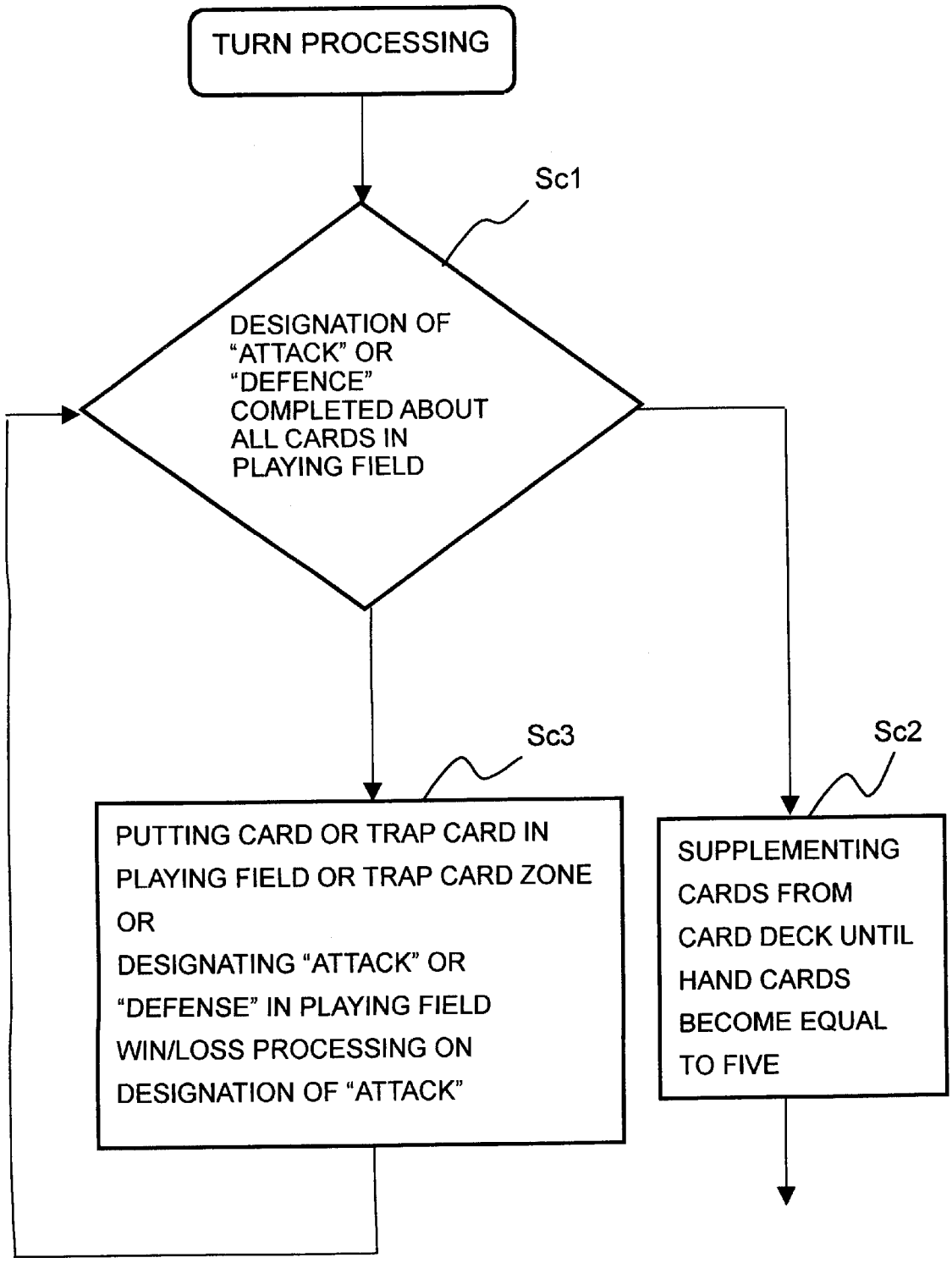
FIG. 22 shows a flow chart for use in describing operation of the game device illustrated in FIG. 21.

Referring to FIG. 22, description is directed to turn processing executed by each of the player and the opponent player in the card game illustrated in FIG. 21. It is to be noted that such turn processing is carried out by the CPU core 26 (FIG. 3) in accordance with a card game program as shown in FIG. 22. In addition, the card game program allows a plurality of cards to be put in the playing field during each turn of the players.

At first, it is judged at a step Sc1 whether or not the attack or the defense is designated about all of the cards arranged in the fighting area. When the attack or the defense is designated in relation to all the cards arranged in the fighting area, the step Sc1 proceeds to a step Sc2 at which cards are extracted from the card deck to be supplemented in the specific zone SP and the trap card zone TP until the hand cards in the specific and the trap card zones SP and TP become equal to five in number.

On the other hand, when the designation of the attack or the defense is not completely finished about all the cards arranged in the fighting area F, the step Sc1 is followed by a step Sc3. At the step Sc3, the card or cards might be put from the specific zone SP to the fighting area F and/or the trap card zone TP. Instead of putting the hand cards and/or the trap card in the fighting area F and/or the trap card zone TP, the attack or the defense might be designated in relation to the cards put in the fighting area. When the attack is designated about the card or cards put in the fighting area F, win/loss processing is carried out in a manner to be described later.

After completion of the step Sc3, the processing is returned back to the step Sc1 to repeat similar operation.

More specifically, the player puts a certain card (called an X-card) in the playing field F and thereafter can continuously put another card (called a Y-card) in the playing field F without designating the attack or the defense about the X-card. After the Y-card is put in the fighting area F, the player can designate the attack or the defense of the X-card. When the attack is designated as regards the X-card, the win/loss processing is executed in connection with the X-card. With reference to a result of the win/loss processing in relation to the X-card, the player determines whether either the attack or the defense is to be designated about the Y-card. Thus, it often happens that, during the turn, designation is made about one of the cards while no designation is made about the remaining cards. In this state, no designation cards are darkly displayed on the screen while the designated cards are lightly displayed.

In the embodiment mentioned above, the plurality of the cards can be put in the fighting area F during each turn. Each turn lasts until the designation of the attack or the defense is finished about all of the cards summoned in the fighting area F. In other words, as long as no designation cards are left in the fighting area F, the player's turn is continued and is not finished. Accordingly, the win/loss processing can be executed during each turn and the designation of the remaining cards may be made with reference to the result of the win/loss processing. Thus, it may be said that the card game according to this embodiment requires a high strategy or tactics.

The above-mentioned win/loss processing is similar to that illustrated in FIG. 20. However, the win/loss processing may be modified in the following manner. For example, when the card which designates the defense wins at the step Sb5, the step Sb6 may be changed such that not only the loser's life points are reduced but also the defeated or lost card may be discarded in the graveyard and may disappear from the screen.

While this invention has thus far been described in conjunction with a few embodiments thereof, it will readily be possible for those skilled in the art to put this invention into practice in various other manners. For example, this invention is applicable not only to the portable game machine but also to a game machine for business. Thus, the card game according to this invention has a simple rule and can enjoy wide variety of customers from an amateur to a mania.

What is claimed is:

1. A computer-readable storage medium having stored therein a program that is readable by a computer to execute a card game composed of a plurality of cards that may be displayed on a screen, the cards having respective capabilities, as measured by ability points, that are different from one another and the cards being grouped into card groups, the computer-readable storage medium comprising:

an electronic storage medium that stores a first card group comprising a plurality of field cards, each of which determines, when placed on the screen, a competition environment different from a competition environment of other of the field cards when it is placed on the screen; and a card file that stores a second card group comprising cards having ability points representing abilities that are varied in dependency upon the competition environments determined by the field cards;

the program comprising the steps of:

determining each competition environment based upon each of the field cards; and executing the card game with reference to the ability points allocated to each card in the second group under each competition environment determined by each field card.

2. A computer-readable storage medium as claimed in claim 1, wherein the cards in said second group have an attack ability and a defense ability and are selectively useable as an attack-type card and a defense-type card and the cards have, as to the ability points, attack ability points and defense ability points that may be used for attack and defense purposes, respectively.

3. A computer-readable storage medium as claimed in claim 2, wherein:

the program comprises the steps of:

distinguishing between the attack ability and the defense ability of each card; and reading either the attack ability points or the defense ability points out of the card file in accordance with a result of distinguishing between the attack and the defense ability of the card.

4. A computer-readable storage medium as claimed in claim 2, wherein the attack ability points and the defense ability points of each second group card are changed in accordance with the competition environments determined by the field cards.

5. A computer-readable storage medium as claimed in claim 4, wherein the program comprises the steps of:

selecting one of the competition environments with reference to the field card; and accessing the card file on the basis of the selected one of the competition environments to determine either the attack ability points or the defense ability points of each card.

6. A computer-readable storage medium as claimed in claim 3, wherein the attack ability points and the defense ability points of each second group card are changed in accordance with the competition environments determined by the field cards.

7. A computer-readable storage medium as claimed in claim 1, wherein the program comprises the steps of:

detecting a specific combination of the cards; and generating a new card which is different from the cards used in the specific combination.

8. A computer-readable storage medium as claimed in claim 1, comprising a special effect card which is operative to cause generation of a special effect for other cards.

9. A computer-readable storage medium as claimed in claim 8, wherein the program comprises the steps of:

detecting appearance of the special effect card; and causing the special effect to occur on appearance of the special effect card.

10. A computer-readable storage medium as claimed in claim 9, wherein the special effect is to temporarily prohibit attack by or defense from an opponent.

11. A computer-readable storage medium as claimed in claim 2 wherein the program comprises the steps of:

designating the attack ability or the defense ability for each card; and displaying each card, with the attack ability and the defense ability distinguished from each other.

12. A computer-readable storage medium as claimed in claim 3, wherein the program further comprises the steps of:

detecting the attack ability; and determining an attacked card of an opponent when a player is using the attack ability of a second group card.

13. A computer-readable storage medium as claimed in claim 3, wherein the program further comprises the step of:

carrying out win or loss processing on the basis of combinations of the attack or defense designated at every one of the cards.

14. A storage device for use in an electronic card game played between players by putting, in a predetermined storage area, cards which have individually assigned thereto a quantity of ability points, comprising:

a storage area which stores the ability points, the number of said points being varied in dependency upon the characteristics of an applicable competition environment.

15. A storage device as claimed in claim 14, wherein the ability points are stored as attack ability points and defense ability points dependent on the characteristics of an applicable competition environment.

16. A storage device as claimed in claim 15, wherein the number of attack ability points and the number of defense ability points of each card are varied as between cards.

17. A storage device as claimed in claim 14, further comprising:

a program storage area which stores a program for executing the card game with reference to at least the number of ability points.

18. A game system operable to play an electronic card game between players by using electronic cards which have assigned thereto a predetermined number of ability points, the number of ability points for each card being determined uniquely by the one of a plurality of selectable competition environments that are predetermined and affect all players, comprising:

storage means for storing the ability points of each of the cards which are predetermined in value on the basis of the competition environment previously selected by a player;

program processing means for processing a program to execute the card game under a selected one of the competition environments with reference to the ability points of the cards as predetermined in the selected competition environment;

a display unit for displaying results of executing the program in the form of an image; and input means for inputting command and data for the card game on the basis of the image displayed on the display unit.

19. An electronic game system operable to support play of a card game between players by utilizing electronically generated cards which have predetermined ability points, comprising:

storage means for storing the ability points of the cards, the characteristics of the cards being variable on the basis of a player-selected one of a plurality of competition environments that are previously prepared and different from one another;

executing means for executing the card game under a player-selected one of the competition environments with reference to the ability points of the cards as determined in the selected competition environment;

a display unit for displaying the results of executing the program in the form of an image; and input means for inputting commands and data for the card game on the basis of the image displayed on the display unit.

20. A game system as claimed in claim 19, wherein the cards are selectively used with respect to an attack ability and a defense ability and the cards have, as the ability points, attack ability points and defense ability points used to define the attack ability and the defense ability, respectively.

21. A game system as claimed in claim 20, wherein the executing means executes the card game with reference to the attack ability points and the defense ability points of each card, said points being varied in dependency upon the competition environments.

22. A game system as claimed in claim 19, wherein the card game further includes a plurality of field cards, each of which is operative to determine the competition environments, respectively.

23. A game system as claimed in claim 19, wherein the executing means processes a specific combination of the cards into a new card different from the cards of the specific combination.

24. A game system operable to play a card game between players within a player-selectable competitive environment by putting, in an electronically displayed playing field, cards which have predetermined ability points, the card game allowing a plurality of the cards to be summoned in the playing field at each turn of the players, the game system comprising:

storage means for storing the ability points of the cards which are varied under the player-selectable competition environments, which are previously prepared and different from one another and uniquely determine the number of ability points assigned to each card;

executing means for executing the card game under a selected one of the competition environments with reference to the ability points of the cards as uniquely determined in a player-selected competition environment;

a display unit for displaying results of executing the program in the form of an image; and input means for inputting command and data for the card game on the basis of the image displayed on the display unit.

25. A game system as claimed in claim 24, wherein the cards are selectively used as an attack type and a defense-type and the cards have, as the ability points, attack ability points and defense ability points that may be used for attack and defense purposes, respectively.

26. A game system as claimed in claim 25, wherein the executing means executes the card game with reference to the attack ability points and the defense ability points of each card which are varied in dependency upon the competition environments.

27. A game system as claimed in claim 24, wherein the card game further includes a plurality of field cards which determine the competition environments, respectively.

28. A game system as claimed in claim 24, wherein the executing means processes a specific combination of the cards into a new card different from the cards of the specific combination.

29. A game system as claimed in claim 24, wherein the card game includes a special effect card which is operative to cause generation of a special effect for other cards.

30. A game system as claimed in claim 29, wherein the executing means detects appearance of the special effect card and causes the special effect for other cards to occur on appearance of the special effect card.

31. A game system as claimed in claim 30, wherein the special effect is to temporarily prohibit attack by or defense from an opponent one of the players.

32. A game system as claimed in claim 30, wherein the display unit has a special zone for locating the special effect card in addition to the playing field.

33. A computer-readable storage medium for storing a program which is readable by the use of a computer to execute a card game composed of a plurality of cards, a first plurality of the cards having ability points different from one another and a second plurality of the cards determining a competition environment for all players, respectively, the program comprising the steps of:

allowing a plurality of the cards, including one of the second plurality of cards, to be put in the playing field at every turn of each player.

34. An image display device operable to play a card game between players by putting, in a playing field, any one or more of a first plurality of cards, each of which has a predetermined number of ability points, respectively assigned on the basis of one of a plurality of selectable competitive environments, the card game allowing a plurality of the cards to be summoned in the playing field at each turn of the players, the image display device comprising:

storage means for storing the ability points of the cards, as varied on the basis of a selected one of the competition environments, said competition environments being previously prepared and different from one another;

executing means for executing the card game under a selected one of the competition environments with reference to the ability points of the cards determined in the selected competition environment;

a display unit for displaying results of executing the program in the form of an image; and input means for inputting command and data for the card game on the basis of the image displayed on the display unit;

the display unit displaying a special card zone for locating a special card which brings about a predetermined effect.

35. An image display device as claimed in claim 34, wherein the executing means detects the special card and carries out processing to cause the predetermined effect to occur in the playing field.

36. An image display device as claimed in claim 35, wherein the predetermined effect is to temporarily prohibit attack or defense of an opponent one of the players.

* * * * *